US009061859B2

(12) United States Patent
Sugiyama et al.

(10) Patent No.: US 9,061,859 B2
(45) Date of Patent: Jun. 23, 2015

(54) SHEET PROCESSING APPARATUS AND IMAGE FORMING SYSTEM

(71) Applicants: Keisuke Sugiyama, Tokyo (JP); Kiyoshi Hata, Tokyo (JP); Atsushi Kikuchi, Kanagawa (JP); Tomomichi Hoshino, Kanagawa (JP); Makoto Hidaka, Tokyo (JP); Shohichi Satoh, Kanagawa (JP); Satoshi Saito, Kanagawa (JP); Takao Watanabe, Kanagawa (JP); Takuya Sano, Kanagawa (JP)

(72) Inventors: Keisuke Sugiyama, Tokyo (JP); Kiyoshi Hata, Tokyo (JP); Atsushi Kikuchi, Kanagawa (JP); Tomomichi Hoshino, Kanagawa (JP); Makoto Hidaka, Tokyo (JP); Shohichi Satoh, Kanagawa (JP); Satoshi Saito, Kanagawa (JP); Takao Watanabe, Kanagawa (JP); Takuya Sano, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/160,671

(22) Filed: Jan. 22, 2014

(65) Prior Publication Data

US 2014/0213425 A1 Jul. 31, 2014

(30) Foreign Application Priority Data

Jan. 28, 2013 (JP) ..... 2013-012986

(51) Int. Cl.

| | |
|---|---|
| ***B31F 1/00*** | (2006.01) |
| ***B65H 45/04*** | (2006.01) |
| ***B65H 45/18*** | (2006.01) |
| ***B65H 45/16*** | (2006.01) |
| ***B65H 37/04*** | (2006.01) |

(52) U.S. Cl.

CPC ..... *B65H 45/04* (2013.01); *B31F 1/0035* (2013.01); *B65H 45/18* (2013.01); *B31F 1/0006* (2013.01); *B31F 1/00* (2013.01); *B65H 45/16* (2013.01); *B65H 37/04* (2013.01); *B65H 2301/51232* (2013.01); *B65H 2701/13212* (2013.01); *B65H 2801/27* (2013.01); *B31F 1/0012* (2013.01)

(58) Field of Classification Search

CPC ..... B65H 45/18; B65H 45/16; B65H 45/12; B31F 1/00; B31F 1/0006; B31F 1/0035

USPC ..... 270/32, 45, 58.07; 493/444

See application file for complete search history.

(56) References Cited

U.S. PATENT DOCUMENTS

| | | | | |
|---|---|---|---|---|
| 5,944,645 | A | 8/1999 | Kobayashi | |
| 6,511,407 | B2 * | 1/2003 | Wahl | 493/405 |
| 7,798,950 | B2 * | 9/2010 | Kobayashi et al. | 493/406 |
| 7,950,641 | B2 * | 5/2011 | Kikkawa et al. | 270/32 |
| 8,353,504 | B2 * | 1/2013 | Hattori et al. | 270/45 |
| 2009/0200725 | A1 | 8/2009 | Tamura et al. | |

(Continued)

FOREIGN PATENT DOCUMENTS

| | | |
|---|---|---|
| JP | 3626316 | 12/2004 |
| JP | 2009-190824 | 8/2009 |

(Continued)

*Primary Examiner* — Leslie A Nicholson, III

(74) *Attorney, Agent, or Firm* — Harness, Dickey & Pierce, P.L.C.

(57) ABSTRACT

A sheet processing apparatus includes: an abutting member that abuts against a sheet surface to bend a sheet; a first moving unit that moves the abutting member; a folding unit that performs a folding process on the sheet bent by the abutting member; a pressing unit that presses a folded portion of the sheet subjected to the folding process; a second moving unit that moves the pressing unit in a direction along a fold of the sheet; and a single operation unit that allows the first moving unit and the second moving unit to be operated.

9 Claims, 22 Drawing Sheets

(56) References Cited

U.S. PATENT DOCUMENTS

| | | | |
|---|---|---|---|
| 2010/0239393 | A1 | 9/2010 | Suzuki et al. |
| 2010/0258994 | A1 | 10/2010 | Kikkawa et al. |
| 2010/0303585 | A1 | 12/2010 | Asami et al. |
| 2010/0310340 | A1 | 12/2010 | Suzuki et al. |
| 2011/0064541 | A1 | 3/2011 | Kikkawa et al. |
| 2011/0091259 | A1 | 4/2011 | Kobayashi et al. |
| 2011/0103919 | A1 | 5/2011 | Furuhashi et al. |
| 2011/0103921 | A1 | 5/2011 | Suzuki et al. |
| 2012/0184423 | A1 | 7/2012 | Hattori |

FOREIGN PATENT DOCUMENTS

| | | |
|---|---|---|
| JP | 4721463 | 4/2011 |
| JP | 2012-148845 | 8/2012 |

* cited by examiner

SHEET PROCESSING APPARATUS AND IMAGE FORMING SYSTEM

CROSS-REFERENCE TO RELATED APPLICATIONS

The present application claims priority to and incorporates by reference the entire contents of Japanese Patent Application No. 2013-012986 filed in Japan on Jan. 28, 2013.

BACKGROUND OF THE INVENTION

1. Field of the Invention

The present invention relates to a sheet processing apparatus that performs a given process on a sheet, and to an image forming system including the sheet processing apparatus.

2. Description of the Related Art

Some of such sheet processing apparatuses are known to perform folding on a sheet on which an image is formed by an image forming apparatus. The sheet processing apparatus disclosed in Japanese Patent No. 4721463 includes a folding plate having an edge that presses a sheet surface of a sheet bundle which is a bundle of a plurality of sheets from a direction perpendicular to the sheet surface at a folding position on the sheet surface, and a folding roller pair positioned facing each other across a moving path of the folding plate, and nipping the sheet bundle. The sheet bundle is folded by causing the folding plate to push the sheet bundle into a sheet folding nip between the folding roller pair, and causing the folding roller pair to convey the sheet bundle while nipping both sides of the folding position.

On the downstream of the folding roller pair in the sheet bundle conveying direction, a fold-enhancing roller pair is also provided. To perform fold-enhancing on the folded portion of the sheet bundle, the fold-enhancing roller pair is moved in a sheet width direction, which is a direction perpendicular to the sheet bundle conveying direction, by receiving a driving force of a driving motor. The fold-enhancing roller pair includes a first roller member and a second roller member each of which has a shaft extending in the sheet bundle conveying direction, and each of which is arranged in a manner facing the other across the sheet bundle. The fold-enhancing roller pair is moved in the sheet width direction, while nipping the folded portion of the sheet bundle between the first roller member and the second roller member, to perform fold-enhancing on the folded portion.

In a configuration in which the folding plate pushes the sheet surface into the sheet folding nip and the fold-enhancing roller pair is moved in the sheet width direction along a fold of the sheet bundle, the operation areas of the folding plate and the fold-enhancing roller pair intersect with the sheet conveying path. Therefore, when any abnormality such as jamming occurs, the folding plate and the fold-enhancing plate need to be returned to their respective home positions provided outside the sheet conveying path so that the sheet bundle remaining in the sheet conveying path can be removed.

The inventors of the present invention have developed a sheet processing apparatus allowing a user to move the folding plate and the fold-enhancing roller pair manually via a drive transmission mechanism, by manually rotating an operation knob. With such a structure, a user can rotate the operation knob to move the folding plate and the fold-enhancing roller pair to their respective home positions, and remove the sheet bundle from the sheet conveying path, when any abnormality occurs.

Because the user manually moves the folding plate and the fold-enhancing roller pair, if a separate operation knob is provided to each of the folding plate and the fold-enhancing roller pair, the operations become cumbersome or take a time.

In consideration of the foregoing, there is a need to provide a sheet processing apparatus that can reduce cumbersomeness and operation time required for an operator to manually make an operation for moving an abutting member and a pressing unit, and to provide an image forming system including the sheet processing apparatus.

SUMMARY OF THE INVENTION

It is an object of the present invention to at least partially solve the problems in the conventional technology.

A sheet processing apparatus includes: an abutting member that abuts against a sheet surface to bend a sheet; a first moving unit that moves the abutting member; a folding unit that performs a folding process on the sheet bent by the abutting member; a pressing unit that presses a folded portion of the sheet subjected to the folding process; a second moving unit that moves the pressing unit in a direction along a fold of the sheet; and a single operation unit that allows the first moving unit and the second moving unit to be operated.

An image forming system includes: an image forming apparatus that forms an image on a sheet; and a sheet processing apparatus that performs a folding process on the sheet on which an image is formed by the image forming apparatus. The sheet processing apparatus includes: an abutting member that abuts against a sheet surface to bend a sheet; a first moving unit that moves the abutting member; a folding unit that performs a folding process on the sheet bent by the abutting member; a pressing unit that presses a folded portion of the sheet subjected to the folding process; a second moving unit that moves the pressing unit in a direction along a fold of the sheet; and a single operation unit that allows the first moving unit and the second moving unit to be operated.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 2:
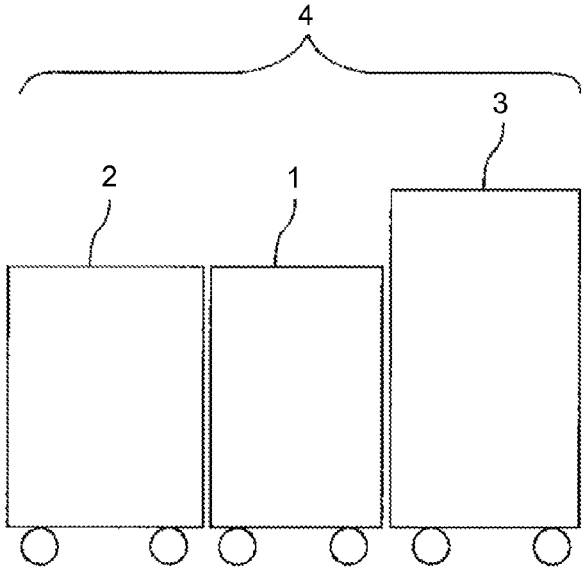
FIG. 2 is a schematic of a system configuration of an image forming system according to an embodiment of the present invention.

FIG. 2 is a schematic of a system configuration of an image forming system 4 including an image forming apparatus and a plurality of sheet processing apparatuses according to an embodiment of the present invention. In this image forming system 4 according to the embodiment, a sheet bundling apparatus 1 that is the first sheet post-processing apparatus, and a saddle stitch binding apparatus 2 that is the second sheet post-processing apparatus are provided sequentially, subsequently to the image forming apparatus 3.

The image forming apparatus 3 forms an image on a sheet based on input image data, or based on image data representing a scanned image. The image forming apparatus 3 corresponds to a copier, a printer, a facsimile, or a digital multi-function product including at least two of these functions, for example. The image forming apparatus 3 is a known image forming apparatus using any image forming method, such as an electrophotographic method or a liquid droplet discharging method. In the embodiment, an electrophotographic copier is used.

Figure 3:
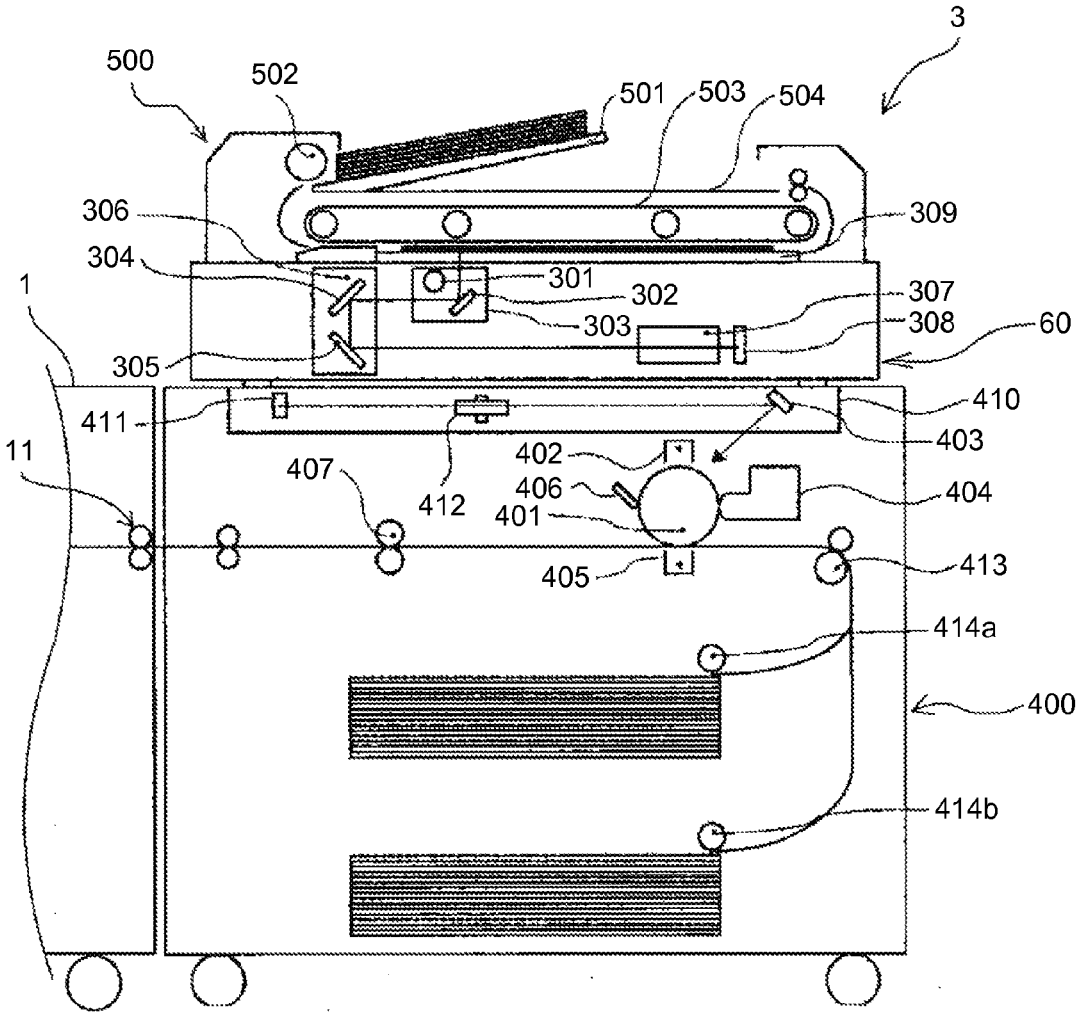
FIG. 3 is a schematic for explaining an image forming apparatus.

FIG. 3 is a schematic for explaining the image forming apparatus 3.

In an image forming apparatus main unit 400, sheet feeding cassettes storing therein sheets that are recording media are provided at a lower part of an image forming unit. Each of the sheets stored in the sheet feeding cassettes is fed by feeding rollers 414*a*, 414*b*, and conveyed upwardly along a given conveying path, and reaches a registration roller pair 413.

The image forming unit includes a photosensitive drum 401 serving as an image carrier, a charging unit 402, an exposing unit 410, a developing unit 404, a transfer unit 405, and a cleaning unit 406.

The charging unit 402 is a charger that charges the surface of the photosensitive drum 401 uniformly. The exposing unit 410 is a latent image forming unit that forms an electrostatic latent image on the photosensitive drum 401 based on image information scanned by an image reading unit 60. The developing unit 404 is a developing unit that visualizes the electrostatic latent image on the photosensitive drum 401 by attaching toner to the latent image. The transfer unit 405 is a transfer unit that transfers the toner image on the photosensitive drum 401 onto a sheet. The cleaning unit 406 is a cleaning unit that removes the toner remaining on the photosensitive drum 401 after the toner image is transferred.

On the downstream of the image forming unit in a sheet conveying direction, a fixing unit 407 serving as a fixing unit that fixes the toner image onto the sheet is provided.

The exposing unit 410 includes a laser unit 411 that outputs a laser beam based on image information under the control of a controlling unit not illustrated, and a polygon mirror 412 that scans the laser beam output from the laser unit 411 in a direction along the rotating shaft of the photosensitive drum 401 (in a main-scanning direction).

An automatic document feeder 500 is connected on the top of the image reading unit 60. The automatic document feeder 500 includes a document table 501, a document separating feeding roller 502, a conveyor belt 503, and a document discharge tray 504.

When a document is placed on the document table 501, and an instruction to start scanning is received, the document separating feeding roller 502 in the automatic document feeder 500 feeds the document on the document table 501 one sheet at a time. The conveyor belt 503 then guides the document onto a platen glass 309, and the document is stopped temporarily.

The image reading unit 60 then reads image information of the document having stopped temporarily on the platen glass 309. The conveyor belt 503 then starts conveying the document again, and discharges the document onto the document discharge tray 504.

An image reading operation and an image forming operation will now be explained.

When the automatic document feeder 500 feeds the document onto the platen glass 309 or when a user places a document on the platen glass 309, and then an operation for starting copying is performed on an operation panel not illustrated, a light source 301 on a first travelling body 303 is turned ON. At the same time, the first travelling body 303 and a second travelling body 306 are moved along guiding rails not illustrated.

The document on the platen glass 309 is then irradiated with the light from the light source 301, and a reflected light is guided by a mirror 302 on the first travelling body 303 and mirrors 304 and 305 on the second travelling body 306 to a lens 307, and becomes incident on a charge-coupled device (CCD) 308. The CCD 308 then reads image information of the document. An analog-to-digital (A/D) conversion circuit not illustrated then converts the image information from analog data to digital data. An information output unit not illustrated then sends the image information to the controlling unit in the image forming apparatus main unit 400.

The image forming apparatus main unit 400 then starts driving the photosensitive drum 401. When the photosensitive drum 401 starts rotating at a predetermined speed, the charging unit 402 charges the surface of the photosensitive drum 401 uniformly. The exposing unit 410 then forms an electrostatic latent image on the charged surface of the photosensitive drum 401 based on image information read by the image reading unit.

The developing unit 404 then develops the electrostatic latent image on the surface of the photosensitive drum 401 into a toner image. A sheet stored in the sheet feeding cassette is fed by the feeding rollers 414*a* and 414*b*, and temporarily stopped at the registration roller pair 413.

The registration roller pair 413 then feeds the sheet to a transfer position facing the transfer unit 405, at a timing synchronized with the timing at which the leading end of the toner image formed on the surface of the photosensitive drum 401 reaches the transfer position. When the sheet is passed through the transfer position, the toner image formed on the surface of the photosensitive drum 401 is transferred onto the sheet, by the action of a transfer electric filed.

The sheet on which the toner image is placed is then conveyed into the fixing unit 407. The fixing unit 407 then performs a fixing process on the sheet, and discharges the sheet into the sheet bundling apparatus 1 subsequently positioned. The cleaning unit 406 removes transfer remaining toner remaining on the surface of the photosensitive drum 401 not transferred onto the sheet at the transfer position.

Figure 4:
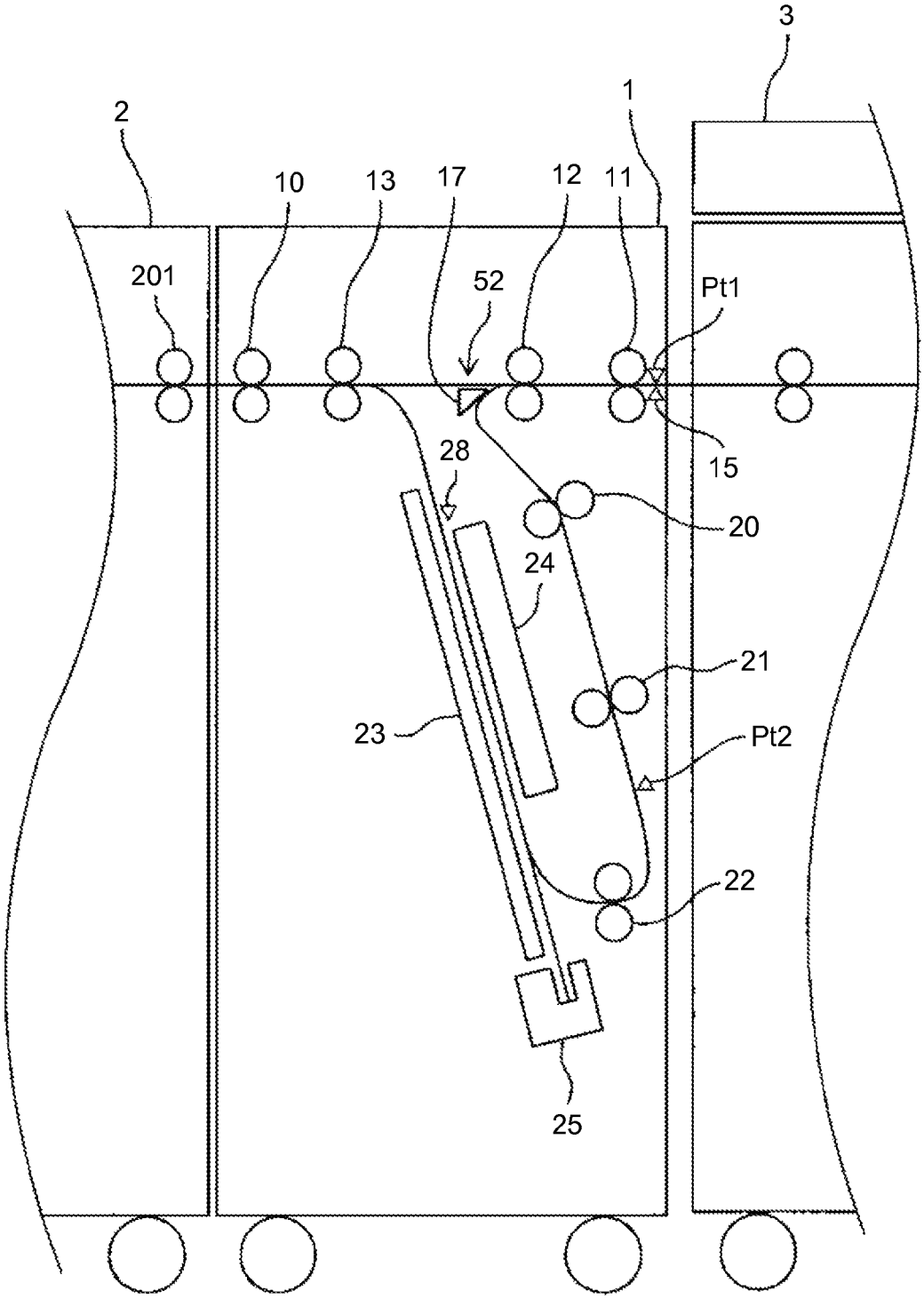
FIG. 4 is a schematic for explaining a sheet bundling apparatus.

FIG. 4 is a schematic for explaining the sheet bundling apparatus 1.

The sheet bundling apparatus 1 is a sheet post-processing apparatus having a sheet bundling function in which sheets are individually received from the image forming apparatus 3, and are sequentially stacked and aligned to form a sheet bundle SB.

The sheet bundling apparatus 1 is provided with a conveying path Pt1 for receiving the sheet discharged from the image forming apparatus 3, and discharging the sheet as it is to the saddle stitch binding apparatus 2 subsequently positioned. The sheet bundling apparatus 1 also provided with a conveying path Pt2 branching from the conveying path Pt1 to allow the sheets to be bundled. Each of the conveying paths Pt1 and Pt2 is formed with respective guiding members (not illustrated), for example.

Along the conveying path Pt1, an entrance roller pair 11, conveying roller pairs 12 and 13, and a discharging roller pair 10 are provided sequentially from the upstream toward the downstream in the sheet conveying direction at the conveying path Pt1.

In the explanation hereunder, the upstream in the sheet conveying direction is sometimes simply referred to as the upstream, and the downstream in the sheet conveying direction is sometimes simply referred to as the downstream.

The entrance roller pair 11, the conveying roller pairs 12 and 13, and the discharging roller pair 10 are driven to rotate by a motor not illustrated to covey a sheet.

An entrance sensor 15 is provided upstream of the entrance roller pair 11 in the sheet conveying direction. The entrance sensor 15 is configured to detect a sheet being fed into the sheet bundling apparatus 1. A rotatable bifurcating claw 17 that is driven by a motor or a solenoid, for example, is provided downstream of conveying roller pair 12 in the sheet conveying direction. By causing the bifurcating claw 17 to rotate, whereby causing the position of the bifurcating claw 17 to change, a sheet is selectively guided into a portion of the conveying path Pt1 at the downstream of the bifurcating claw 17 in the sheet conveying direction or into the conveying path Pt2.

In a discharge mode, the entrance roller pair 11, the conveying roller pairs 12 and 13, and the discharging roller pair 10 convey the sheet fed from the image forming apparatus 3 into the conveying path Pt1, and discharge the sheet into the saddle stitch binding apparatus 2 subsequently positioned.

In a sheet bundling mode, the entrance roller pair 11 and the conveying roller pair 12 further convey the sheet fed into the conveying path Pt1, and the bifurcating claw 17 changes the direction in which the sheet is conveyed, so that the sheet is conveyed to the conveying path Pt2.

The conveying path Pt2 is provided with conveying roller pairs 20, 21, and 22, a sheet accumulating tray 23, jogger fences 24, and a trailing end reference fence 25, for example. The conveying roller pairs 20, 21, and 22 and the jogger fences 24 are driven by a motor not illustrated.

The sheet conveyed into the conveying path Pt2 is sequentially accumulated on the sheet accumulating tray 23. In this manner, a sheet bundle that is a stack of a plurality of sheets is formed. The sheet bundle is aligned in the sheet conveying direction by a movable reference fence (not illustrated) and the trailing end reference fence 25 provided to the sheet accumulating tray 23, and is aligned in the width direction by the jogger fences 24. The movable reference fence is driven by a motor.

The sheet accumulating tray 23, the jogger fences 24, the trailing end reference fence 25 and the movable reference fence are configured as a bundling unit 28 serving as a bundling unit that stacks a plurality of sheets into a sheet bundle. The bundling unit 28 includes a motor for driving the jogger fences 24 and a motor for driving the movable reference fence.

The movable reference fence then conveys the sheet bundle bundled in the bundling unit 28 into the conveying path Pt1, and the conveying roller pair 13 and the discharging roller pair 10 then discharge the sheet bundle into the saddle stitch binding apparatus 2 subsequently positioned.

Figure 5:
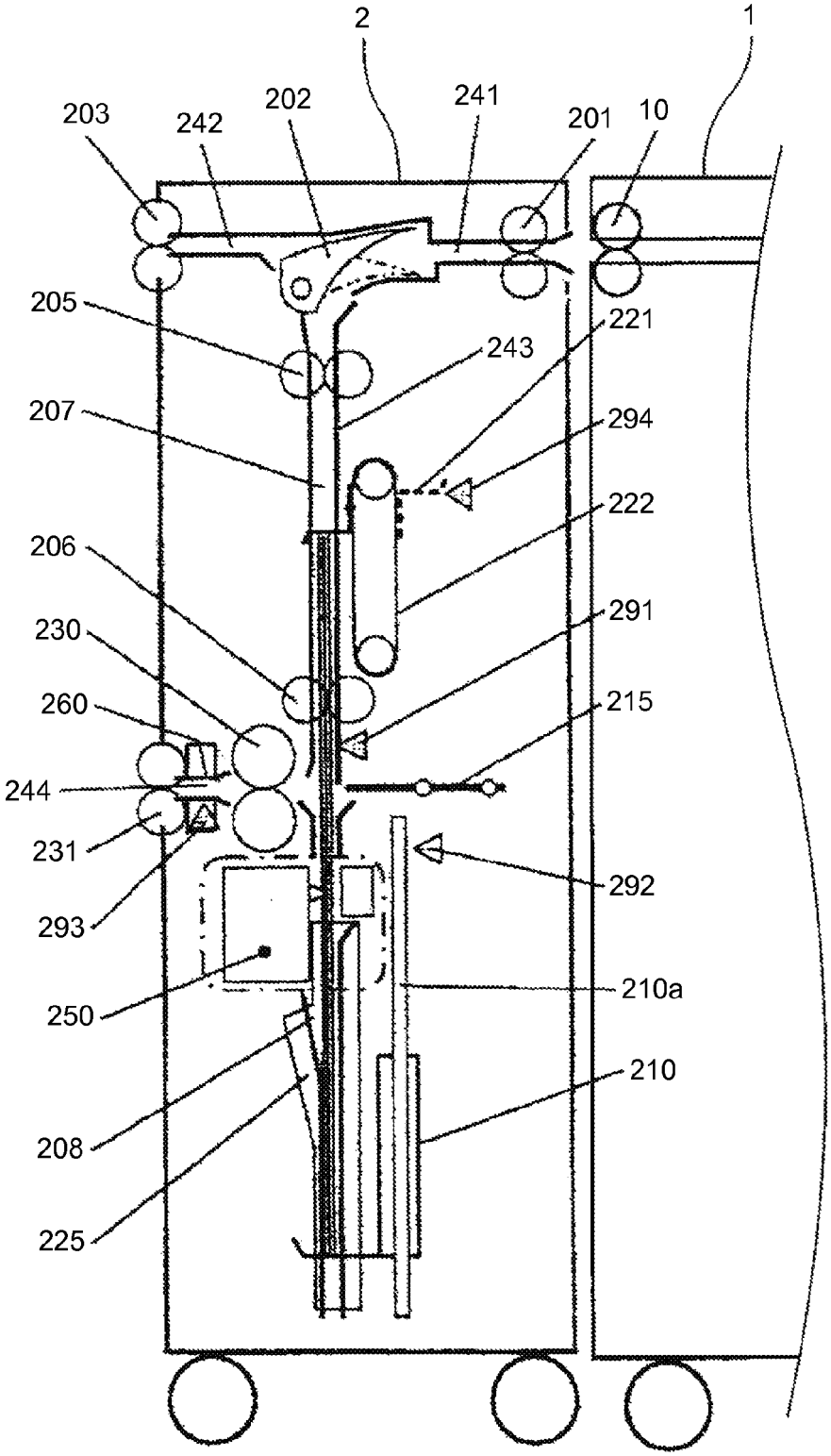
FIG. 5 is a schematic for explaining a saddle stitch binding apparatus.

FIG. 5 is a schematic for explaining the saddle stitch binding apparatus 2. The saddle stitch binding apparatus 2 receives the sheet bundle SB discharged from the sheet bundling apparatus 1, and performs a saddle stitching process and a center folding process on the sheet bundle.

The saddle stitch binding apparatus 2 includes an entrance conveying path 241, a sheet-through conveying path 242, and a center-folding conveying path 243. An entrance roller pair 201 is provided to the entrance conveying path 241 and most upstream in the sheet conveying direction. The entrance roller pair 201 conveys the sheet bundle SB discharged by the discharging roller pair 10 in the sheet bundling apparatus 1 to the saddle stitch binding apparatus 2.

A bifurcating claw 202 is provided rotatably to the entrance conveying path 241 and downstream of the entrance roller pair 201. The bifurcating claw 202 is provided in the horizontal direction in FIG. 5 to bifurcate the conveying direction of the sheet bundle SB to the sheet-through conveying path 242 and to the center-folding conveying path 243.

The sheet-through conveying path 242 is a conveying path that extends horizontally from the entrance conveying path 241, and guides the sheet bundle SB to a discharge tray not illustrated or into a sheet processing apparatus not illustrated subsequently positioned. The sheet bundle SB conveyed through the sheet-through conveying path 242 is then discharged by upper discharging rollers 203 onto the discharge tray or into the sheet processing apparatus subsequently positioned.

The center-folding conveying path 243 is a conveying path that extends downwardly in a vertical direction from the position of the bifurcating claw 202, and where the sheet bundle SB is subjected to the saddle stitching process and the center folding process, for example.

The center-folding conveying path 243 is provided with a folding plate 215 that folds the sheet bundle SB along the center. The center-folding conveying path 243 is also provided with an upper sheet bundle conveying guiding plate 207 for guiding the sheet bundle SB in an area above the folding plate 215, and a lower sheet bundle conveying guiding plate 208 that guides the sheet bundle SB in an area below the folding plate 215.

The upper sheet bundle conveying guiding plate 207 provided with upper sheet bundle conveying rollers 205, a trailing end tapping claw 221, and lower sheet bundle conveying rollers 206, sequentially from the top.

The trailing end tapping claw 221 stands on a trailing end tapping claw driving belt 222 that is driven by a driving motor not illustrated. The trailing end tapping claw 221 is caused to tap (to push) the trailing end of the sheet bundle SB toward a movable fence, which is to be described later, by the back-and-forth rotating movement of the trailing end tapping claw driving belt 222, and aligns the sheet bundle SB. The trailing end tapping claw 221 is retracted from the center-folding conveying path 243 (the position indicated by a dotted line in FIG. 2) when the sheet bundle SB is fed and when the sheet bundle SB is elevated to be provided with center folding.

A trailing end tapping claw home position sensor 294 is configured to detect the home position of the trailing end tapping claw 221, and detect the position indicated by the dotted line in FIG. 2 (the position indicated by a solid line in FIG. 5) at which the trailing end tapping claw 221 is retracted from the center-folding conveying path 243, as the home position. The trailing end tapping claw 221 is controlled with reference to the home position.

The lower sheet bundle conveying guiding plate 208 is provided with a saddle stitching stapler 250, saddle stitching jogger fences 225, and a movable fence 210, sequentially from the top.

The lower sheet bundle conveying guiding plate 208 is a guiding plate that receives the sheet bundle SB conveyed along the upper sheet bundle conveying guiding plate 207. A pair of the saddle stitching jogger fences 225 are provided, in the width direction of the lower sheet bundle conveying guiding plate 208. Below the lower sheet bundle conveying guiding plate 208, the movable fence 210 against which the leading end of a sheet bundle abuts is provided.

The saddle stitching stapler 250 is a stapler for binding the sheet bundle SB at the center. The movable fence 210 moves in the vertical direction while the leading end of the sheet bundle SB is held in contact with the movable fence 210 so as to bring the center of the sheet bundle SB to the position facing the saddle stitching stapler 250. At this position, the sheet bundle SB is stapled, that is, saddle-stitched.

The movable fence 210 is supported by a movable fence driving mechanism 210*a*. The movable fence 210 is movable upwardly to the level of a movable fence home position sensor 292 included in the movable fence driving mechanism 210*a*, and is movable downwardly to the lowest position of the movable fence driving mechanism 210*a*.

The movable range of the movable fence 210 against which the leading end of the sheet bundle SB abuts is ensured to have a range for allowing the maximum size to the minimum size of a sheet that can be handled by the saddle-stitch binding apparatus 2 to be processed. As the movable fence driving mechanism 210*a*, a rack-and-pinion mechanism is used, for example.

Between the upper sheet bundle conveying guiding plate 207 and the lower sheet bundle conveying guiding plate 208, that is, almost at the center of the center-folding conveying path 243, the folding plate 215, a folding roller pair 230, a fold-enhancing roller unit 260, lower discharging rollers 231, and the like are provided.

The fold-enhancing roller unit 260 is provided with an upper fold-enhancing roller 261*a* and a lower fold-enhancing roller 262*a* which are a pair of rollers that are respectively positioned above and below a sheet discharging path between the folding roller pair 230 and lower discharging rollers 231.

The folding plate 215 can be reciprocated horizontally in FIG. 5. The nip between the folding roller pair 230 is positioned downstream in a direction toward which the folding plate 215 is moved to perform a folding operation, and a discharging conveying path 244 is provided along the extension of the direction.

The lower discharging rollers 231 are provided most downstream of the discharging conveying path 244, and discharge the folded sheet bundle SB to the subsequent stage.

A sheet bundle detecting sensor 291 is provided near the lower end of the upper sheet bundle conveying guiding plate 207, and is configured to detect the leading end of the sheet bundle SB fed into the center-folding conveying path 243 and passing through the center-folding position. A folded portion passage sensor 293 is provided to the discharging conveying path 244, and is configured to detect the leading end of the sheet bundle SB folded at the center so as to recognize the passage of the sheet bundle SB.

The saddle-stitch binding apparatus 2 having a general structure illustrated in FIG. 2 performs the saddle stitching operation and the center folding operation as illustrated in schematics for explaining operations in FIGS. 6 to 10. To explain specifically, when a user selects saddle stitching/center folding on an operation panel not illustrated provided to the image forming apparatus 3, the bifurcating claw 202 is rotated in the counterclockwise direction, and the sheet bundle SB for which the saddle stitching/center folding is selected is guided from the entrance conveying path 241 into the center-folding conveying path 243. In the embodiment, the bifurcating claw 202 is driven by a solenoid. However, the bifurcating claw 202 may also be driven by a motor instead of a solenoid.

Figure 6:
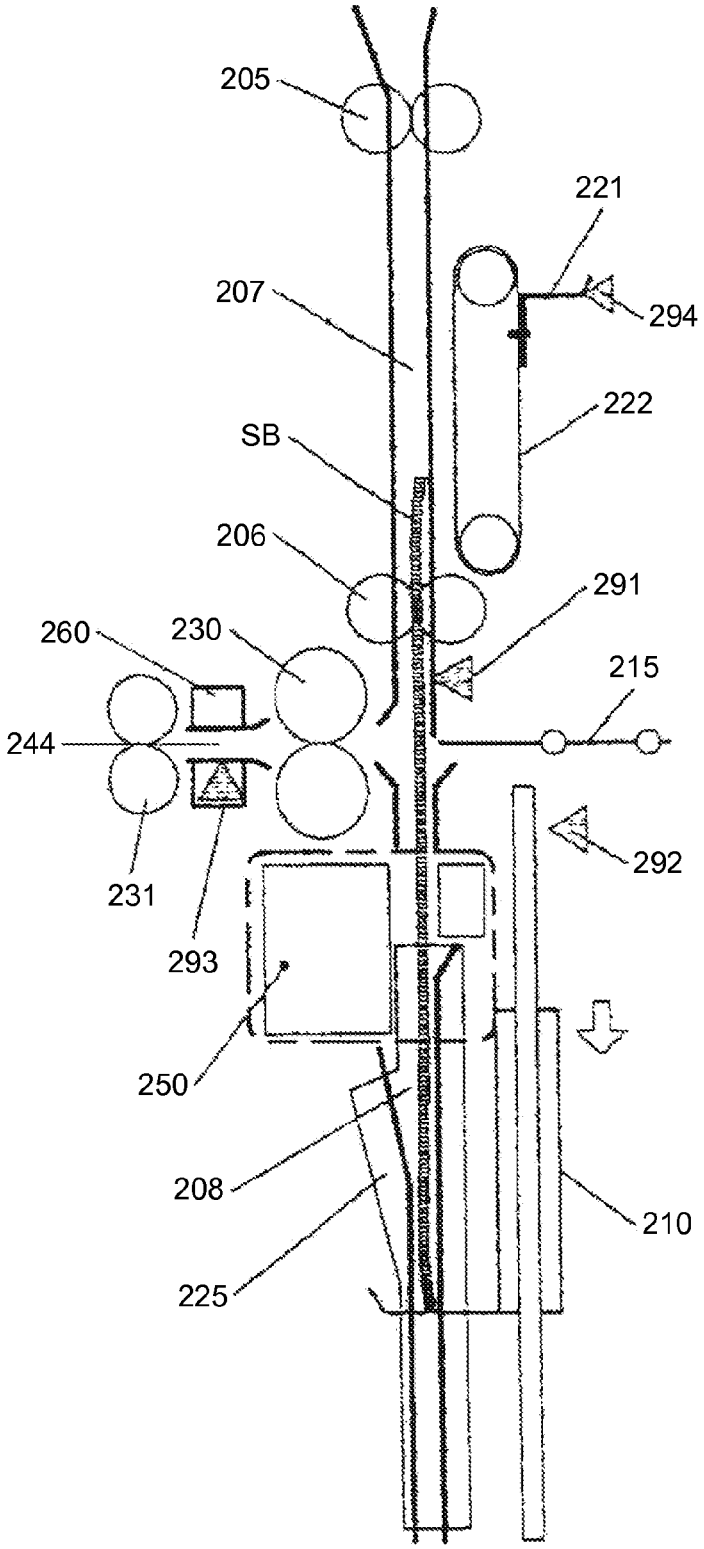
FIG. 6 is a schematic for explaining an operation of the saddle stitch binding apparatus, illustrating a state in which a sheet bundle is being conveyed into a center-folding conveying path.

The sheet bundle SB fed into the center-folding conveying path 243 is further conveyed downwardly in the center-folding conveying path 243 by the entrance roller pair 201 and the upper sheet bundle conveying rollers 205. After the sheet bundle detecting sensor 291 recognizes the passage of the sheet bundle SB, the sheet bundle SB is conveyed by the lower sheet bundle conveying rollers 206 to a position at which the leading end of the sheet bundle SB abuts against the movable fence 210, as illustrated in FIG. 6.

At this time, the movable fence 210 is on standby at a standby position determined based on sheet size information received from the image forming apparatus 3, e.g., in this example, information of the size of each sheet bundle SB in the conveying direction. At this time, in FIG. 6, the sheet bundle SB is held between the nip of the lower sheet bundle conveying rollers 206, and the trailing end tapping claw 221 is on standby at the home position.

Figure 7:
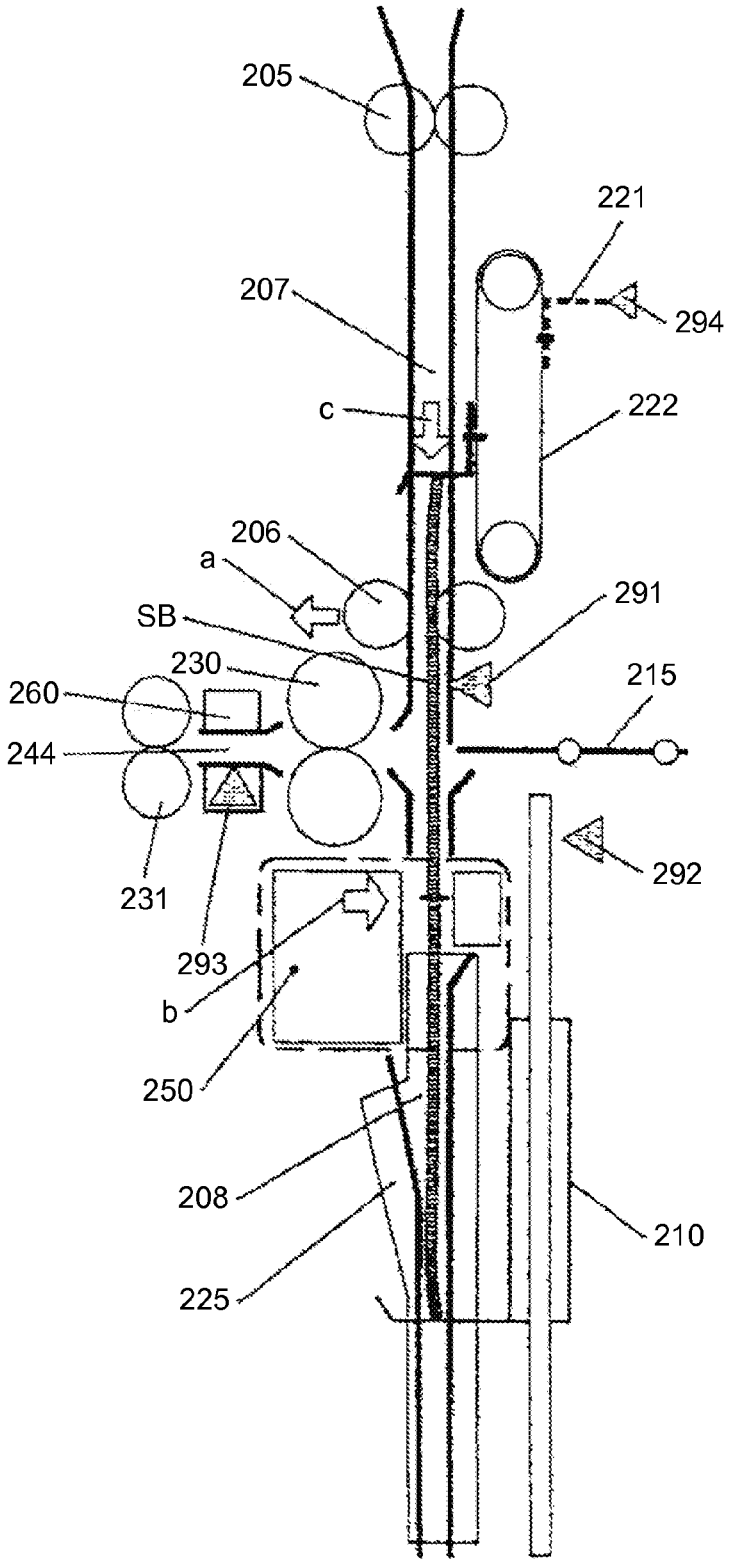
FIG. 7 is a schematic for explaining an operation of the saddle stitch binding apparatus, illustrating a state in which the sheet bundle is being saddle-stitched.

When the nipping force of the lower sheet bundle conveying rollers 206 is released, as illustrated in FIG. 7 (in the direction of the arrow a in FIG. 7), the leading end of the sheet bundle SB is caused to fall and to abut against the movable fence 210, while the trailing end of the sheet bundle SB is no longer held. The trailing end tapping claw 221 is then driven and caused to tap the trailing end of the sheet bundle SB to perform the final alignment of the sheet bundle SB in the conveying direction (in the direction of the arrow c in FIG. 7).

The saddle stitching jogger fences 225 then align the sheet bundle SB in the width direction (in the direction perpendicular to the sheet conveying direction). In the manner described above, aligning operations of the sheet bundle SB in the width direction and in the conveying direction are performed, and the aligning operations of the sheet bundle SB in the width direction and the conveying direction are completed. Before these aligning operations are performed, the respective amounts by which the sheet bundle SB is pushed by the trailing end tapping claw 221 and the saddle stitching jogger fences 225 are adjusted to the most appropriate values based on the information of the sheet size, information of the number of sheets in the sheet bundle SB, information of the thickness of the sheet bundle, and the like.

When the sheet bundle SB is thick, the space inside of the center-folding conveying path 243 becomes reduced. Therefore, the sheet bundle SB often cannot be completely aligned by performing these aligning operations only once. In such a case, the number of times by which the sheet bundle SB is aligned is increased. In this manner, the sheet bundle SB can be better aligned.

When the number of sheets is larger, the time required for the sheet bundling apparatus 1 positioned prior to the saddle stitch binding apparatus 2 to sequentially stack a plurality of sheets by which the sheet bundle SB is formed increases. Therefore, the time required for the saddle stitch binding apparatus 2 to receive the next sheet bundle SB from the sheet bundling apparatus 1 becomes extended. Hence, no time loss is incurred even if the number of times by which the saddle stitch binding apparatus 2 aligns the sheet bundle SB is increased. As a result, a sheet bundle can be better aligned efficiently. It is also possible to control the number of times by which the saddle stitch binding apparatus 2 aligns the sheet bundle SB based on the processing time required prior to the saddle stitch binding apparatus 2, e.g., in the sheet bundling apparatus 1.

The standby position of the movable fence 210 is usually set to a position where the position of the sheet bundle SB to be saddle stitched reaches a position facing the saddle stitching position of the saddle stitching stapler 250. If the sheet bundle SB is aligned at this position, the saddle stitching stapler 250 can bind the sheet bundle SB at that position in the center-folding conveying path 243 where the sheet bundle SB is stacked, without moving the movable fence 210 to match the saddle stitching position of the sheet bundle SB. The stitcher in the saddle stitching stapler 250 is then driven in a direction of the arrow b in FIG. 7 at the standby position toward the center of the sheet bundle SB, and binds the sheet bundle SB between the stitcher and a clincher. In this manner, the sheet bundle SB is saddle-stitched.

The movable fence 210 is positioned based on pulse control from the movable fence home position sensor 292, and the trailing end tapping claw 221 is positioned based on pulse control from the trailing end tapping claw home position sensor 294. The control for positioning the movable fence 210 and the trailing end tapping claw 221 is executed by a central processing unit (CPU) in a control circuit not illustrated included in the saddle-stitch binding apparatus 2.

Figure 8:
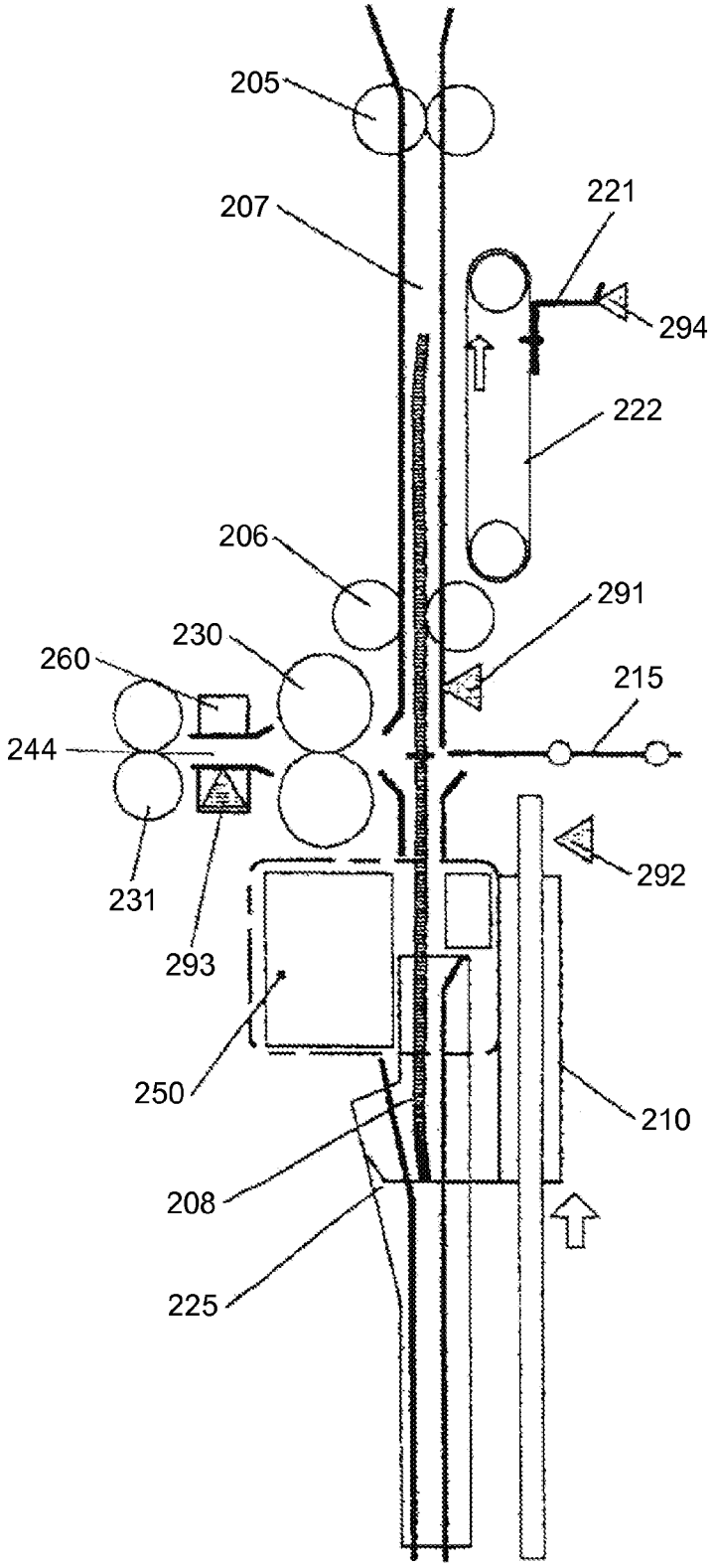
FIG. 8 is a schematic for explaining an operation of the saddle stitch binding apparatus, illustrating a state in which the sheet bundle is completely fed to a center folding position.

As the movable fence 210 is lifted upwardly, the sheet bundle SB that is saddle-stitched in the state illustrated in FIG. 7 is conveyed to a position where the saddle stitched position faces the folding plate 215, while the lower sheet bundle conveying rollers 206 are separated from each other, as illustrated in FIG. 8. This position is also controlled with reference to the position detected by the movable fence home position sensor 292. The saddle stitched position herein is a center of the sheet bundle SB in the conveying direction.

Figure 9:
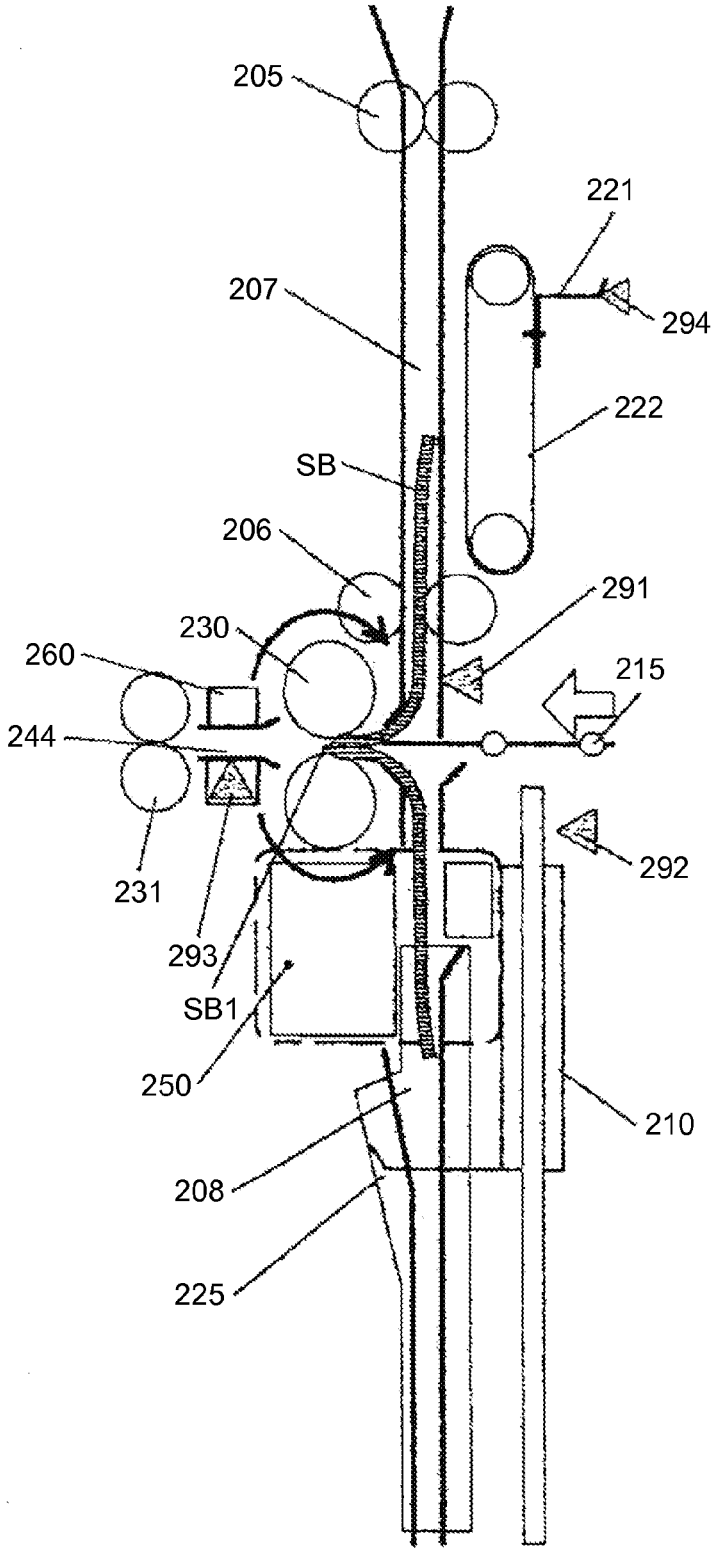
FIG. 9 is a schematic for explaining an operation of the saddle stitch binding apparatus, illustrating a state in which the sheet bundle is being center-folded.

When the sheet bundle SB reaches the position illustrated in FIG. 8, the folding plate 215 is caused to move toward the nip of the folding roller pair 230, to abut against the sheet bundle SB at a position near the staple part where the sheet bundle SB is bund, from a direction approximately perpendicular to the sheet bundle SB, and to push the sheet bundle SB toward the nip of the folding roller pair 230, as illustrated in FIG. 9.

The sheet bundle SB is pushed by the folding plate 215, guided toward the nip of the folding roller pair 230, and pushed into the nip of the folding roller pair 230 already rotating. The folding roller pair 230 conveys the sheet bundle SB pushed into the nip of the folding roller pair 230 while applying pressure to the sheet bundle SB. This pressing and conveying operation enables the sheet bundle SB to be folded along the center, and a simple-bound sheet bundle SB is formed. FIG. 9 illustrates a configuration in which the leading end of the folded portion SB1 of the sheet bundle SB is nipped and pressed by the nip of the folding roller pair 230.

Figure 10:
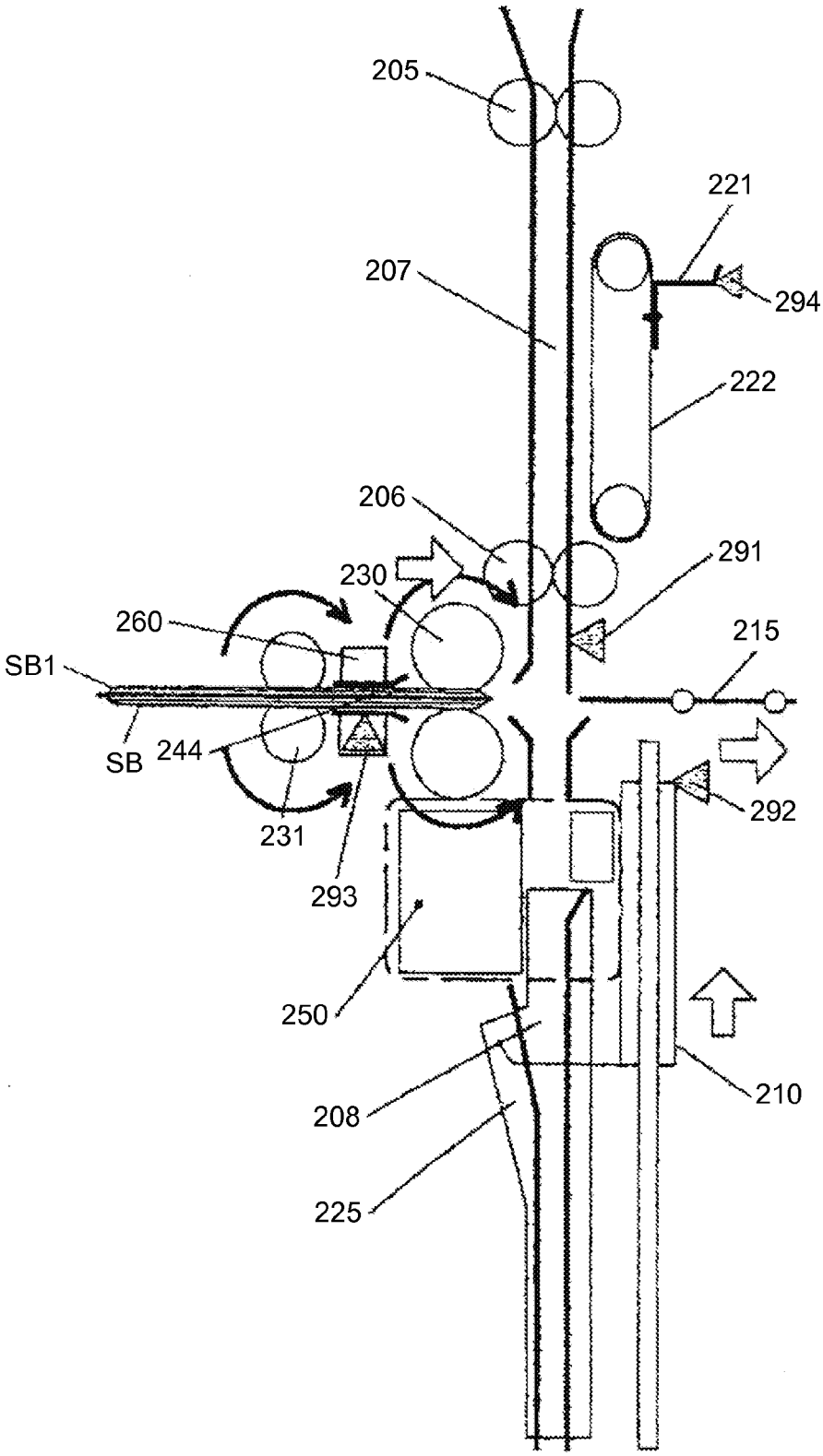
FIG. 10 is a schematic for explaining an operation of the saddle stitch binding apparatus, illustrating a state in which the center-folded sheet bundle is being discharged.

The sheet bundle SB folded in two along the center in the state illustrated in FIG. 9 is conveyed by the folding roller pair 230, as illustrated in FIG. 10, conveyed by the lower discharging rollers 231, and discharged to the subsequent stage. When the folded portion passage sensor 293 detects the trailing end of the sheet bundle SB, the folding plate 215 and the movable fence 210 are returned to their respective home positions, and the lower sheet bundle conveying rollers 206 return to the pressing state to prepare for conveyance of the next sheet bundle SB.

If the next job is for a sheet bundle SB having the same size and the same number of sheets, the movable fence 210 may return to and be on standby at the position illustrated in FIG. 6. The control described above is also executed by the CPU in the control circuit.

Figure 11:
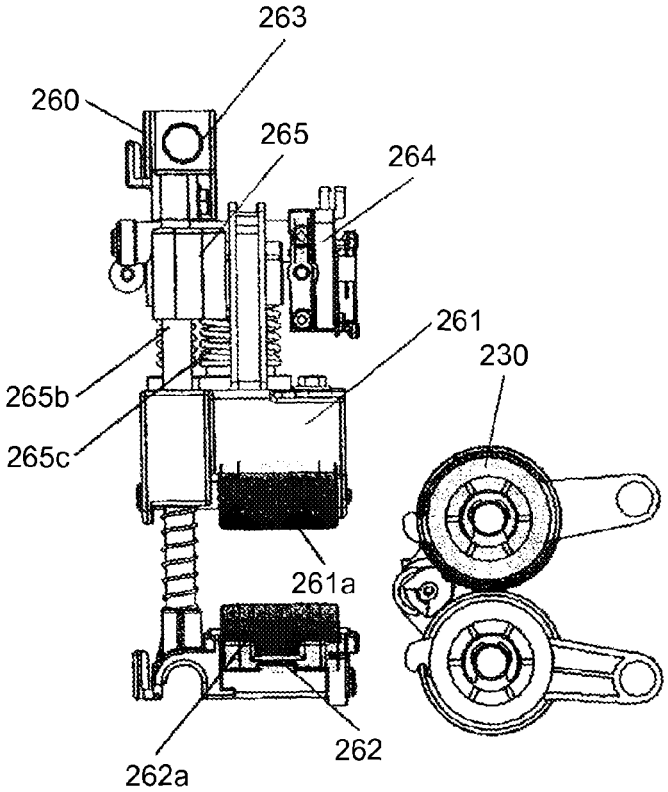
FIG. 11 is a front view of a relevant portion of a fold-enhancing roller unit and a folding roller pair.
Figure 12:
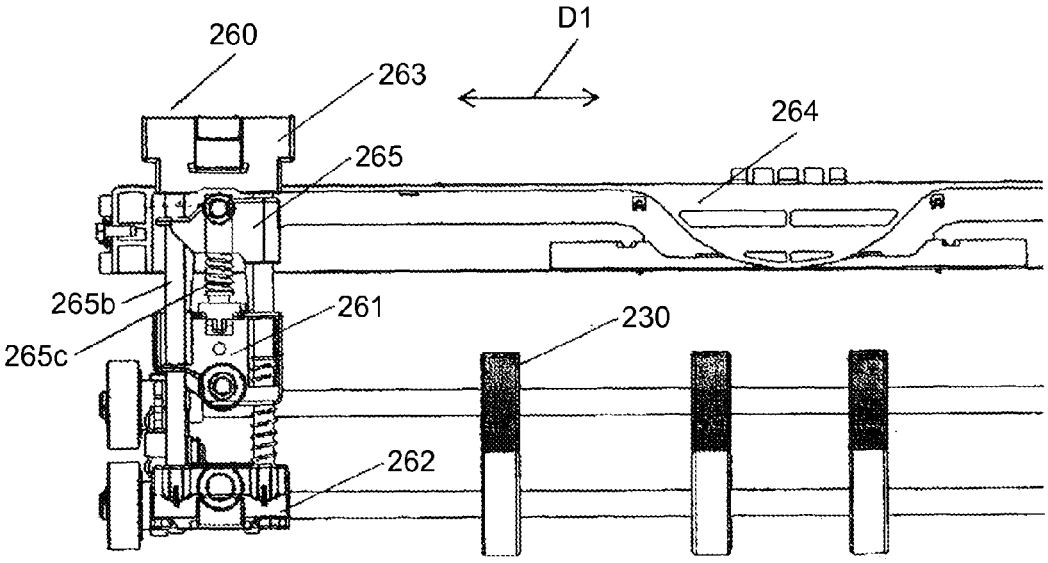
FIG. 12 is a side view of the relevant portion illustrated in FIG. 11 viewed from the left.

FIG. 11 is a front view of a relevant portion of the fold-enhancing roller unit 260 and the folding roller pair 230. FIG. 12 is a side view of the relevant portion illustrated in FIG. 11 viewed from the left.

The fold-enhancing roller unit 260 is positioned between the folding roller pair 230 and the lower discharging rollers 231 on the discharging conveying path 244, and includes a unit moving mechanism 263, a guiding member 264, and a pressing mechanism 265.

Each roller of the folding roller pair 230 is configured as skewered rollers in which a plurality of rollers are arranged to be spaced from one another along the axial direction.

The unit moving mechanism 263 reciprocates the fold-enhancing roller unit 260 in the depth directions in FIG. 11 (the direction perpendicular to the sheet conveying direction) along the guiding member 264, using the driving source and the driving mechanism not illustrated.

The pressing mechanism 265 is a mechanism that includes an upper fold-enhancing roller unit 261 and a lower fold-enhancing roller unit 262, and presses the sheet bundle SB by applying pressure in the vertical direction using the upper fold-enhancing roller unit 261 and the lower fold-enhancing roller unit 262.

The upper fold-enhancing roller unit 261 is supported by a support member 265*b* movably in the vertical direction with respect to the unit moving mechanism 263, and the lower fold-enhancing roller unit 262 is mounted immovably at the lower end of the support member 265*b* of the pressing mechanism 265.

The upper fold-enhancing roller 261*a* in the upper fold-enhancing roller unit 261 can be pressed against the lower fold-enhancing roller 262*a* in the lower fold-enhancing roller unit 262, and the sheet bundle SB is nipped between and pressed by these two fold-enhancing rollers. The pressing force is given by a pressing spring 265*c* that presses the upper fold-enhancing roller unit 261 with its elastic force. The pressing mechanism 265 is moved in the width directions (in the direction of the arrow D1 in FIG. 12) of the sheet bundle SB while pressing the sheet bundle SB, in the manner explained later, and performs fold-enhancing on a folded portion SB1.

Figure 13:
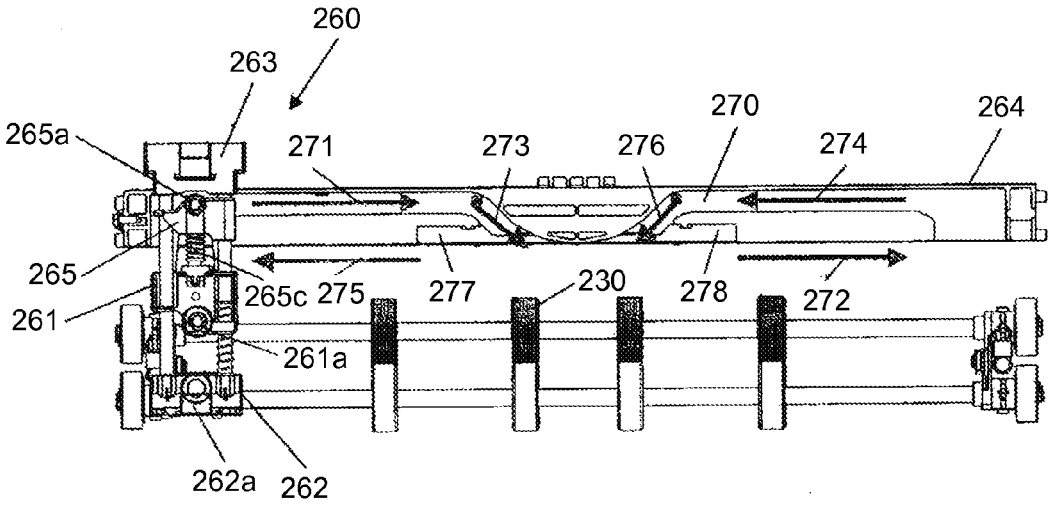
FIG. 13 is a detailed schematic of a guiding member.

FIG. 13 is a detailed schematic of the guiding member 264. The guiding member 264 includes a guiding path 270 by which the fold-enhancing roller unit 260 is guided in the width direction of the sheet bundle SB. In the guiding path 270, a first guiding path 271, a second guiding path 272, a third guiding path 273, a fourth guiding path 274, a fifth guiding path 275, and a sixth guiding path 276, six paths in total, are defined.

The first guiding path 271 is a path that guides the pressing mechanism 265 in a non-pressing state in the forward movement. The second guiding path 272 is a path that guides the pressing mechanism 265 in a pressing state in the forward movement. The third guiding path 273 is a path that switches the pressing mechanism 265 from the non-pressing state to the pressing state in the forward movement. The fourth guiding path 274 is a path that guides the pressing mechanism 265 in the non-pressing state in the reverse movement. The fifth guiding path 275 is a path that guides the pressing mechanism 265 in the pressing state in the reverse movement. The sixth guiding path 276 is a path that switches the pressing mechanism 265 from the non-pressing state to the pressing state in reverse movement.

Figure 14:
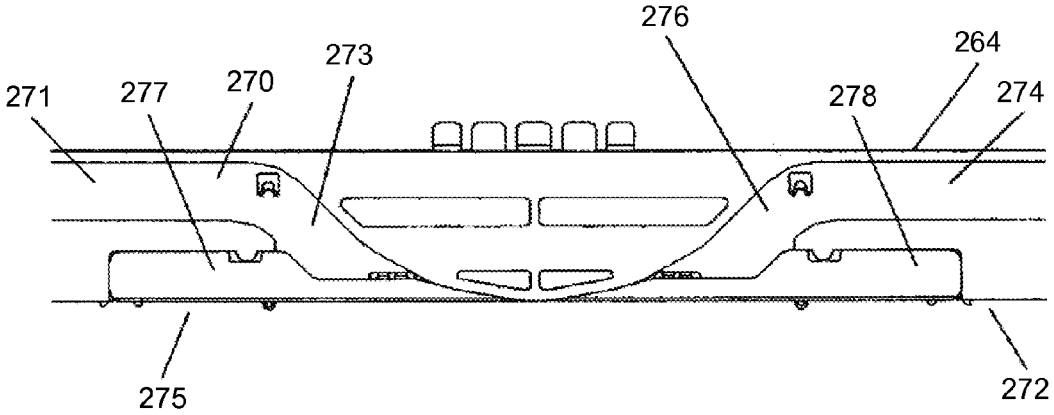
FIG. 14 is an enlarged view of the relevant portion illustrated in FIG. 13 before path switching claws are switched.
Figure 15:
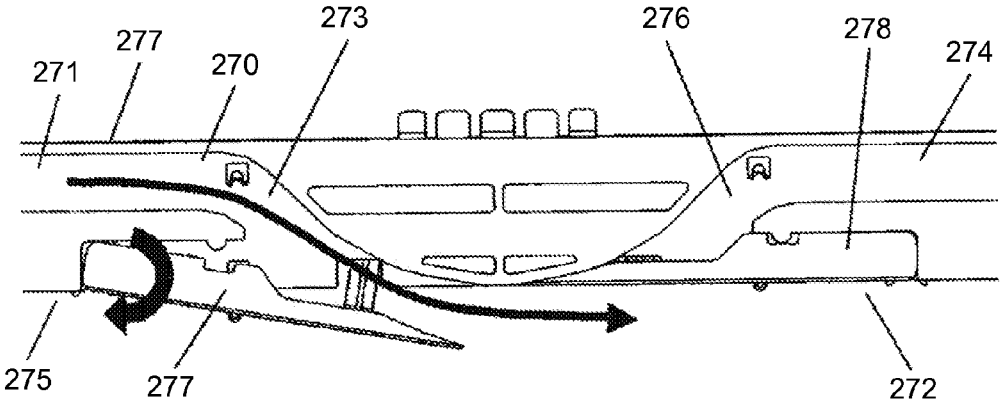
FIG. 15 is an enlarged view of the relevant portion illustrated in FIG. 13 after a first path switching claw is switched.

FIGS. 14 and 15 are enlarged views of the relevant portion illustrated in FIG. 13. The arrow in FIG. 15 indicates the trajectory of a movement of a guide pin 265*a* in the pressing mechanism 265.

As illustrated in FIGS. 14 and 15, a first path switching claw 277 and a second path switching claw 278 are provided at an intersection between the third guiding path 273 and the second guiding path 272 and an intersection between the sixth guiding path 276 and the fifth guiding path 275, respectively.

The pressing mechanism 265 moves along the guiding path 270 because the guide pin 265*a* in the pressing mechanism 265 is movably and loosely fitted into the guiding path 270. In other words, the guiding path 270 functions as a cam groove, and the guide pin 265*a* functions as a cam follower that changes its position as it moves along the cam groove.

The first path switching claw 277 is rotated to switch the guiding path from the third guiding path 273 to the second guiding path 272, by being pushed down by the guide pin 265*a* in the pressing mechanism 265, as illustrated in FIG. 15. The second path switching claw 278 is rotated to switch the guiding path from the sixth guiding path 276 to the fifth guiding path 275 by being pushed down by the guide pin 265*a* in the pressing mechanism 265.

The first path switching claw 277 is incapable of switching the guiding path from the second guiding path 272 to the third guiding path 273, and the second path switching claw 278 is incapable of switching the guiding path from the fifth guiding path 275 to the sixth guiding path 276. In other words, the first path switching claw 277 and the second path switching claw 278 are configured to be incapable of switching the guiding path in the opposite directions.

FIGS. 16 to 26 are schematics for explaining an operation of fold-enhancing by the fold-enhancing roller unit 260.

Figure 16:
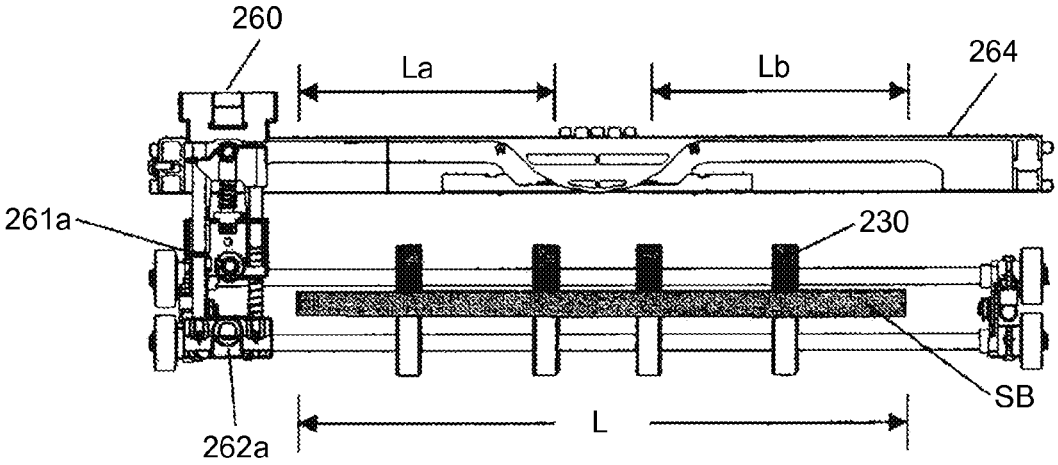
FIG. 16 is a schematic for explaining an initial state of a fold-enhancing operation.

FIG. 16 illustrates a state in which the sheet bundle SB folded by the folding roller pair 230 has been fed and stopped at the predetermined fold-enhancing position, and the fold-enhancing roller unit 260 is still at the standby position. This state is the initial position for the fold-enhancing operation.

Figure 17:
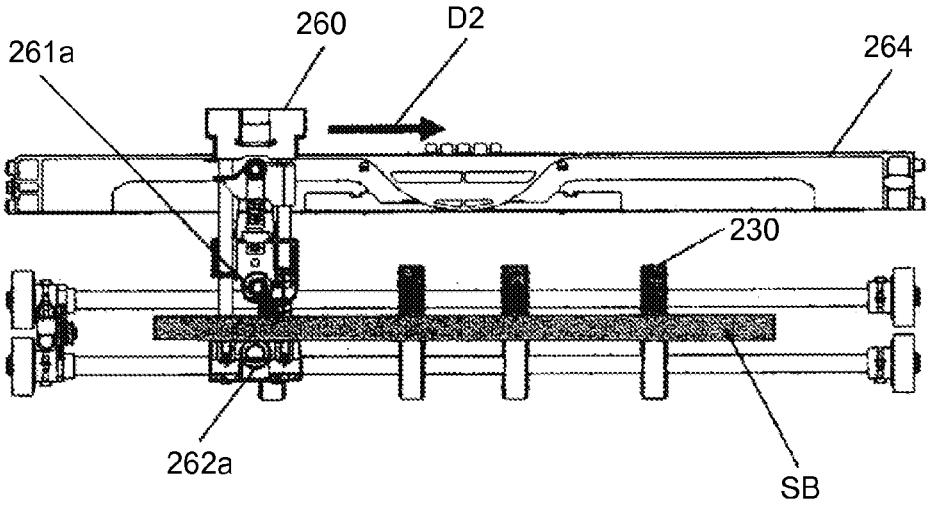
FIG. 17 is a schematic for explaining an operation when the fold-enhancing roller unit starts forward movement.

The fold-enhancing roller unit 260 then starts the forward movement from the initial position illustrated in FIG. 16 to the right (in the direction of the arrow D2), as illustrated in FIG. 17. At this time, the pressing mechanism 265 in the fold-enhancing roller unit 260 is moved along the guiding path 270 by the action of the guide pin 265*a* Immediately after the operation is started, the pressing mechanism 265 is moved along the first guiding path 271. At this time, the upper fold-enhancing roller 261*a* and the lower fold-enhancing roller 262*a* are in the non-pressing state.

The non-pressing state herein means a state in which the upper fold-enhancing roller 261*a* and the lower fold-enhancing roller 262*a* are held in contact with the sheet bundle SB but apply almost no pressure to the sheet bundle SB, or a state in which the upper fold-enhancing roller 261*a* and the lower fold-enhancing roller 262*a* are kept away from the sheet bundle SB.

Figure 18:
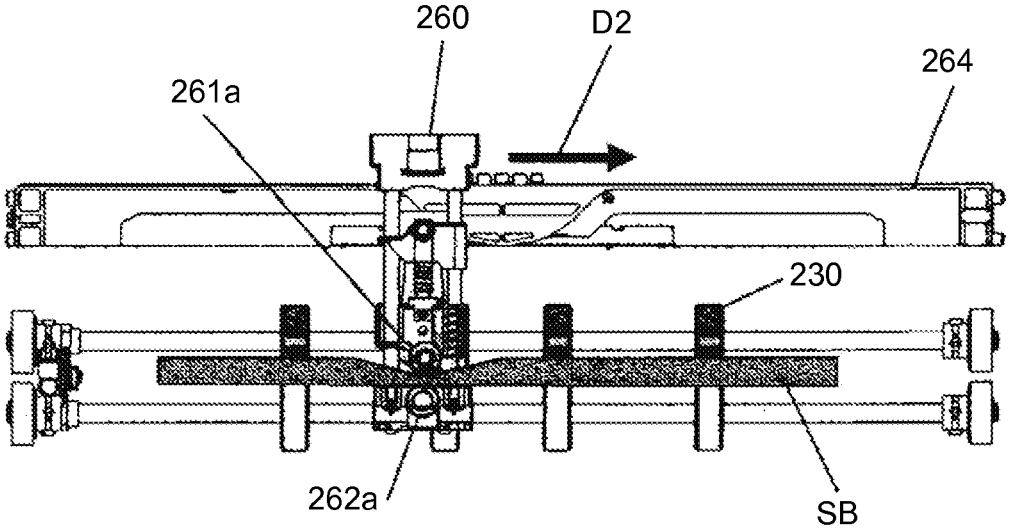
FIG. 18 is a schematic for explaining an operation when the fold-enhancing roller unit enters a third guiding path near the center of the sheet bundle.
Figure 19:
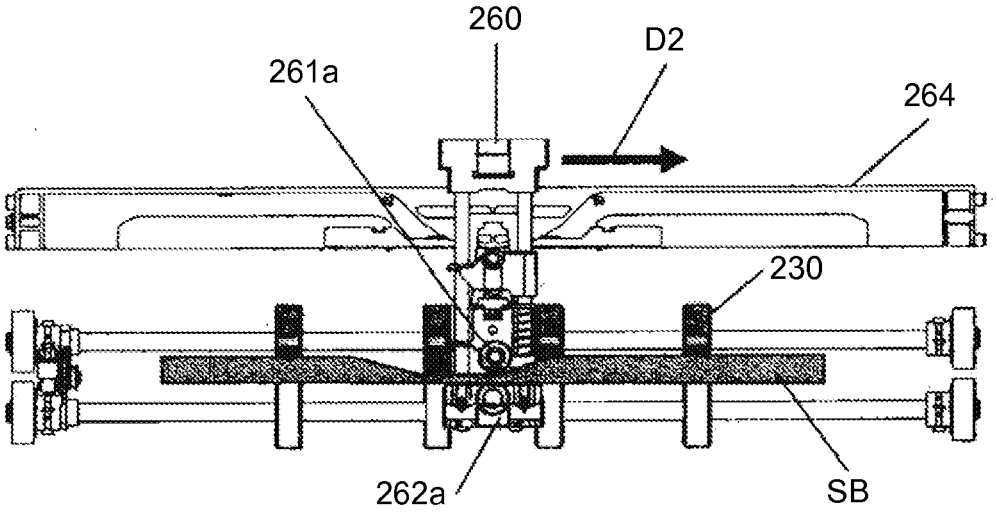
FIG. 19 is a schematic for explaining an operation when the fold-enhancing roller unit pushes the first path switching claw away and then enters a second guiding path.

When the fold-enhancing roller unit 260 approaches the third guiding path 273 near the center of the sheet bundle SB, as illustrated in FIG. 18, the pressing mechanism 265 starts being guided along the third guiding path 273 and become lowered, whereby pushing the first path switching claw 277 away, and enters the second guiding path 272, as illustrated in FIG. 19. At this time, the pressing mechanism 265 comes to press the upper fold-enhancing roller unit 261, whereby bringing the upper fold-enhancing roller unit 261 into contact with the sheet bundle SB, and the sheet bundle SB nipped between the upper fold-enhancing roller 261*a* and the lower fold-enhancing roller 262*a* is pressed by these fold-enhancing rollers.

Figure 20:
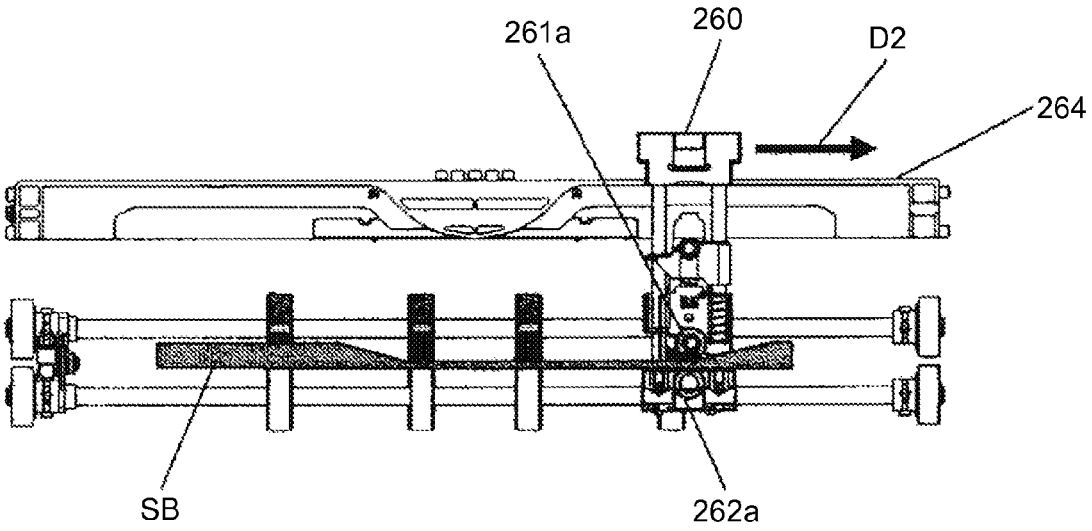
FIG. 20 is a schematic for explaining an operation when the fold-enhancing roller unit is moved in a direction toward an end of the sheet bundle while pressing the sheet bundle.
Figure 21:
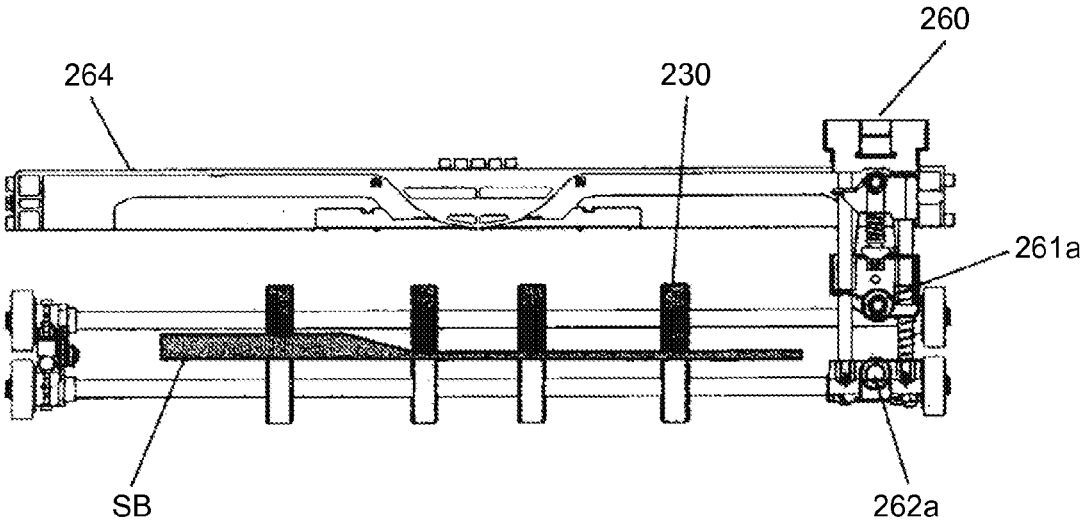
FIG. 21 is a schematic for explaining an operation when the fold-enhancing roller unit reaches a finishing point of the forward movement along the second guiding path.

The fold-enhancing roller unit 260 pressing the sheet bundle SB is then further moved in the direction of the arrow D2 in FIG. 20, as illustrated in FIG. 20. Because the second path switching claw 278 cannot move in the opposite direction, the guide pin 265*a* in the pressing mechanism 265 is moved along the second guiding path 272, without entering the sixth guiding path 276, further moved outside the sheet bundle SB, and reaches the finishing point of the forward movement, as illustrated in FIG. 21.

Once the fold-enhancing roller unit 260 is moved to this point, the guide pin 265*a* in the pressing mechanism 265 is transferred from the second guiding path 272 into the fourth guiding path 274 positioned at a higher level. As a result, the position restriction of the guide pin 265*a* by the upper surface of the second guiding path 272 is removed, whereby the upper fold-enhancing roller 261*a* is separated from the lower fold-enhancing roller 262*a*, and the upper fold-enhancing roller 261*a* is brought into the non-pressing state.

Figure 22:
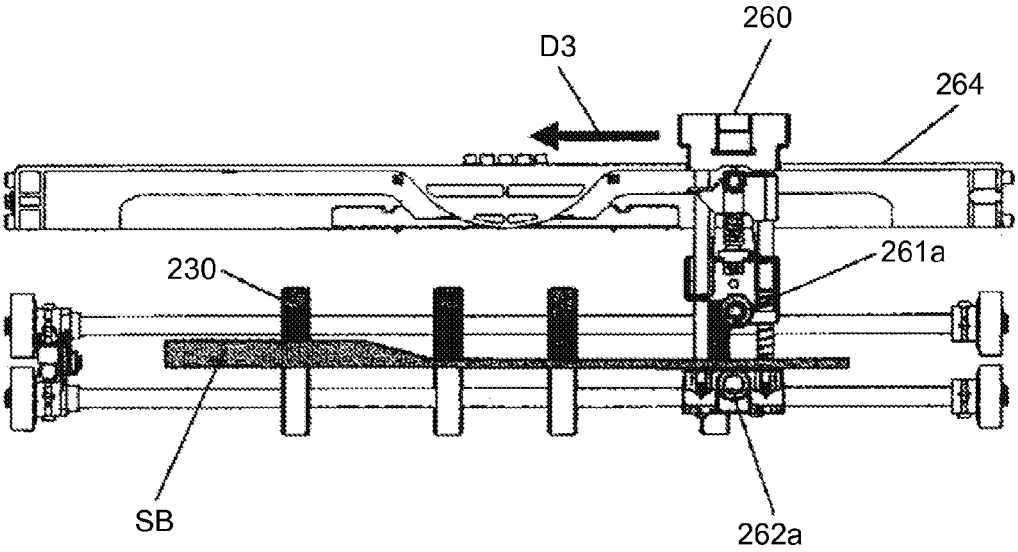
FIG. 22 is a schematic for explaining an operation when the fold-enhancing roller unit starts reverse movement from the finishing point of the forward movement.
Figure 23:
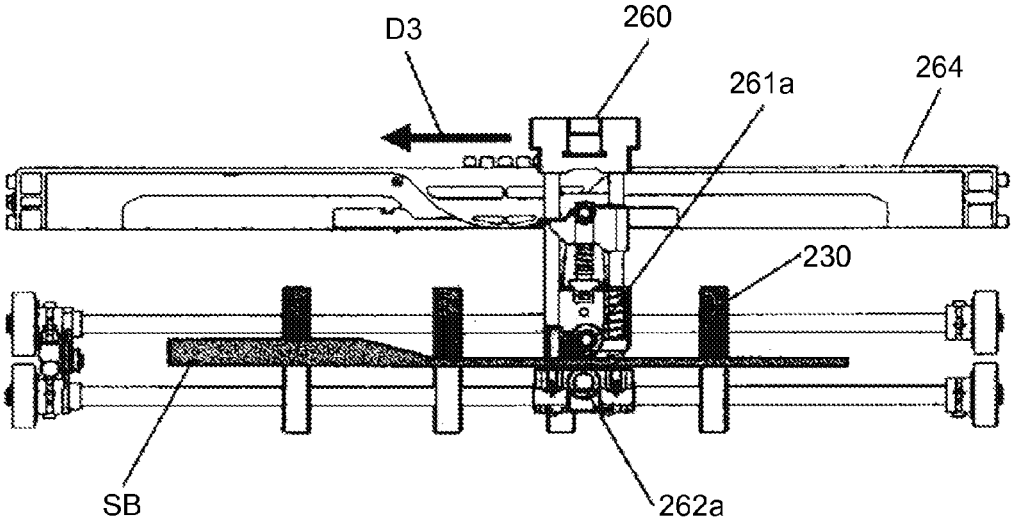
FIG. 23 is a schematic for explaining an operation when the fold-enhancing roller unit starts reverse movement and reaches a sixth guiding path.
Figure 24:
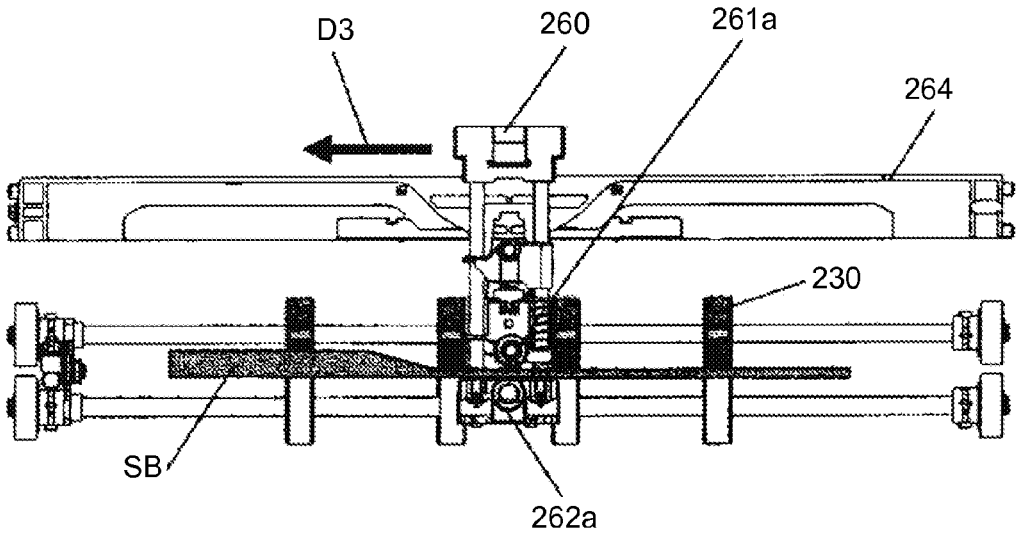
FIG. 24 is a schematic for explaining an operation when the fold-enhancing roller unit reaches the sixth guiding path and is transferred to a pressing state from a non-pressing state.

The unit moving mechanism 263 then moves the fold-enhancing roller unit 260 in a reverse direction as illustrated in FIG. 22. In the reverse movement, the pressing mechanism 265 is moved to the left in FIG. 22 along the fourth guiding path 274 (in the direction of the arrow D3). Once the pressing mechanism 265 reaches the sixth guiding path 276, as illustrated in FIG. 23, the guide pin 265*a* follows the shape of the sixth guiding path 276 and presses down the second path switching claw 278. The pressing mechanism 265 is then transferred from the non-pressing state to the pressing state, as illustrated in FIG. 24.

Figure 25:
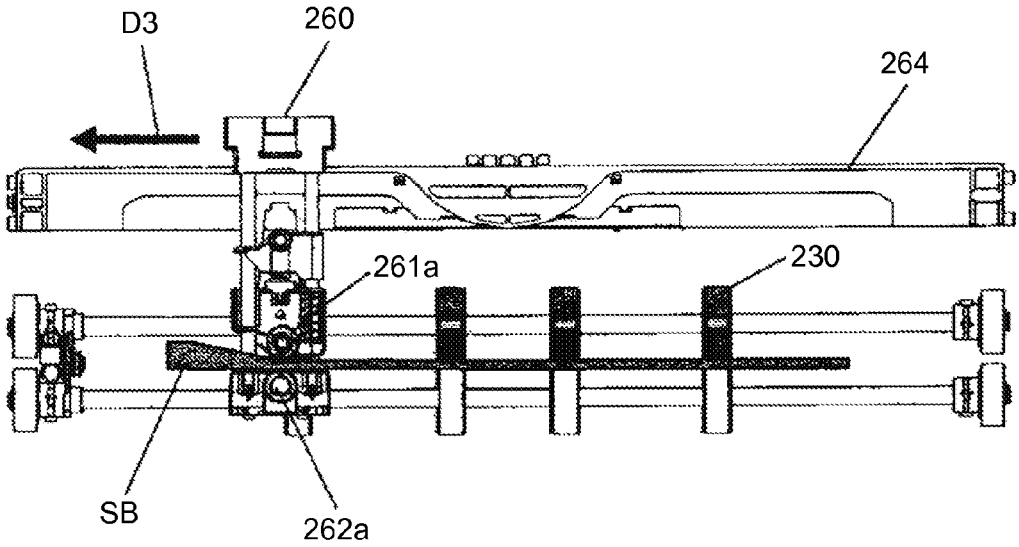
FIG. 25 is a schematic for explaining an operation when the fold-enhancing roller unit enters the fifth guiding path and is completely transferred to the pressing state.
Figure 26:
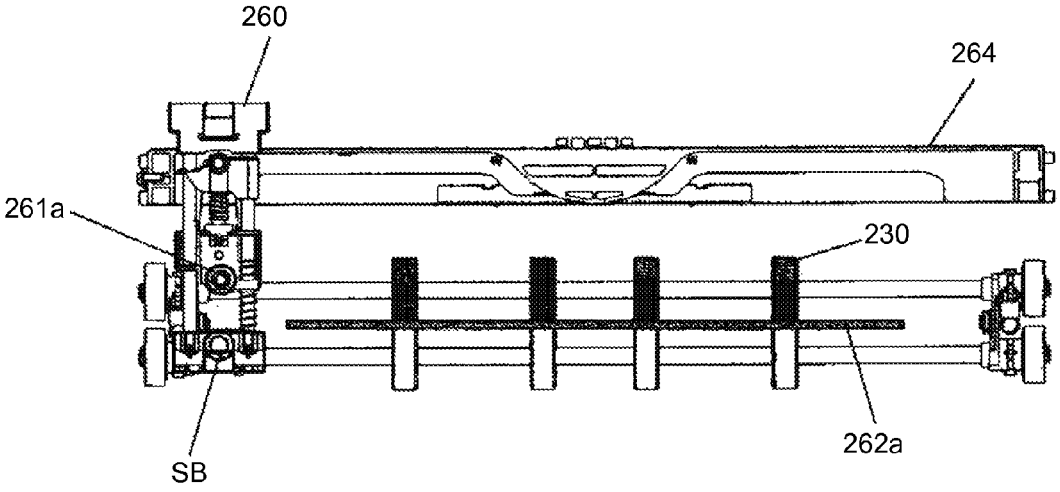
FIG. 26 is a schematic for explaining an operation when the fold-enhancing roller unit continues moving through the fifth guiding path and returns to the initial position.

Once the fold-enhancing roller unit 260 enters the fifth guiding path 275, as illustrated in FIG. 25, the fold-enhancing roller unit 260 is completely brought into the pressing state. The fold-enhancing roller unit 260 is then moved along the fifth guiding path 275 in the direction of the arrow D3, and moved outside the sheet bundle SB, as illustrated in FIG. 26.

The sheet bundle SB is thus fold-enhanced by causing the fold-enhancing roller unit 260 to reciprocate along the guiding path 270. At this time, the fold-enhancing roller unit 260 starts the fold-enhancing from the central portion toward one end of the sheet bundle SB, and is moved outside one end of the sheet bundle SB. The fold-enhancing roller unit 260 is then moved above the fold-enhanced part of the sheet bundle SB, starts fold-enhancing from the central portion toward the other end of the sheet bundle, and moved outside the other end. Through this operation, fold-enhancing is performed on the sheet bundle SB.

By allowing the fold-enhancing roller unit 260 to operate in the manner described above, when the fold-enhancing roller unit 260 starts fold-enhancing and when the fold-enhancing roller unit 260 starts returning to the other end after being moved outside the one end, the upper fold-enhancing roller 261*a* and the lower fold-enhancing roller 262*a* are neither in contact with each other nor apply any pressure to the ends of the sheet bundle SB from the outside of the sheet bundle SB. In other words, when the fold-enhancing roller unit 260 is moved across each of the ends of the sheet bundle SB from the outside of that end, the fold-enhancing roller unit 260 is in the non-pressing state. Therefore, the end of the sheet bundle SB is not damaged.

Furthermore, because fold-enhancing is performed from near the center toward an end of the sheet bundle SB, the distance by which the fold-enhancing roller unit 260 is moved in contact with the sheet bundle SB to perform fold-enhancing can be reduced, and a twist possibly resulting in a wrinkle is hard to be accumulated. Therefore, when fold-enhancing is applied to the folded portion SB1 of the sheet bundle SB, the ends of the sheet bundle SB are not damaged, and turns or wrinkles at the folded portion SB1 and portions near the folded portion SB1 resulting from accumulation of the twist can be reduced.

In order to prevent the upper fold-enhancing roller 261*a* and the lower fold-enhancing roller 262*a* from rolling over each of the ends of the sheet bundle SB from the outside of that end, the following relation needs to be satisfied. In other words, when La denotes a distance by which the fold-enhancing roller unit 260 forwardly moves on the sheet bundle SB without pressing the sheet bundle SB, and Lb denotes a distance by which the fold-enhancing roller unit 260 reversely moves on the sheet bundle SB without pressing the sheet bundle SB, as understood from the operation illustrated in FIGS. 16 to 26, a relation between a width direction length L of the sheet bundle SB, and the distances La and Lb must satisfy L>La+Lb (FIGS. 16 to 18, FIGS. 21 to 23).

It is also preferable to set the distance La and the distance Lb to be almost the same, and to start pressing the sheet bundle SB near the center in the width direction of the sheet bundle SB (FIGS. 20 and 24).

The fold-enhancing roller unit 260 according to the embodiment has the lower fold-enhancing roller unit 262, and fold-enhancing is performed by nipping the sheet bundle SB between the upper fold-enhancing roller 261*a* and the lower fold-enhancing roller 262*a*. However, it is also possible not to provide the lower fold-enhancing roller unit 262, and to provide the upper fold-enhancing roller unit 261 and a bearer member not illustrated having an abutting surface facing the upper fold-enhancing roller unit 261, and to allow these two members to press the sheet bundle SB.

Furthermore, in the fold-enhancing roller unit 260 according to the embodiment, the upper fold-enhancing roller unit 261 is configured movably in the vertical directions, and the lower fold-enhancing roller unit 262 is configured immovably in the vertical directions. However, the structure is not limited thereto. In other words, the lower fold-enhancing roller unit 262 may also be configured movable in the vertical directions. Such a structure allows the upper fold-enhancing roller 261*a* and the lower fold-enhancing roller 262*a* to be brought into contact and separated from each other symmetrically with respect to the fold-enhancing position. Therefore, the fold-enhancing position can be kept constant regardless of the thickness of the sheet bundle SB, and damages such as a scratch given to the sheet bundle SB can be further reduced.

Figure 1:
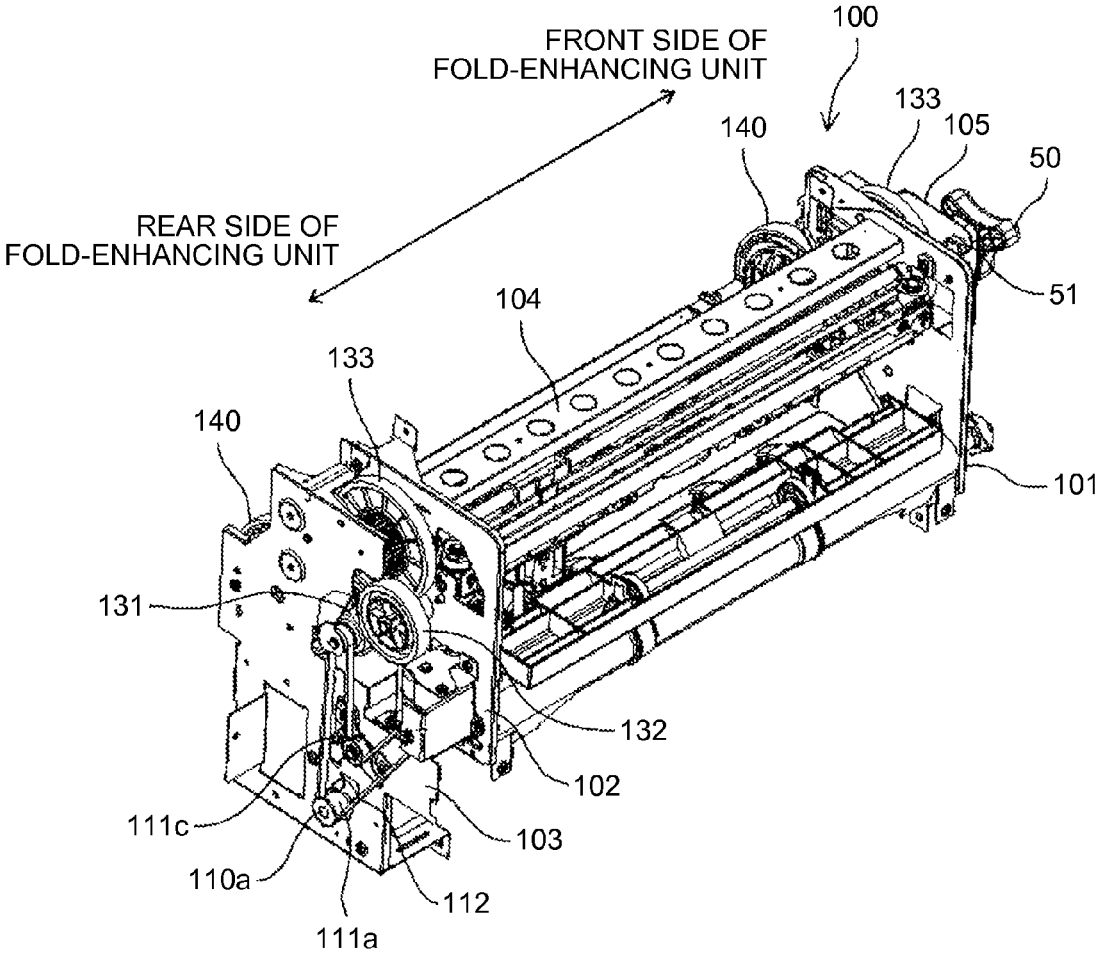
FIG. 1 is a schematic of a fold-enhancing unit.

FIG. 1 is a schematic of a fold-enhancing unit 100.

The fold-enhancing unit 100 has a structure including a front side plate 101, a front auxiliary side plate 105, a rear side plate 102, a rear auxiliary side plate 103, and a stay 104.

A driving source for driving the folding plate 215 and the fold-enhancing roller unit 260, and a drive transmission mechanism for transmitting the driving force from the driving source to the folding plate 215 and to the fold-enhancing roller unit 260 are assembled onto the rear side plate 102 and the rear auxiliary side plate 103.

The front side plate 101 and the front auxiliary side plate 105 support an operation knob 50 for allowing a user to manually operate the folding plate 215 and the fold-enhancing roller unit 260, in a manner rotatable about a rotating shaft. On an end of the rotating shaft of the operation knob 50 closer to the front side plate 101, an operation knob gear 51 engaging with a third folding plate gear 133, which is described later, is provided.

Figure 27:
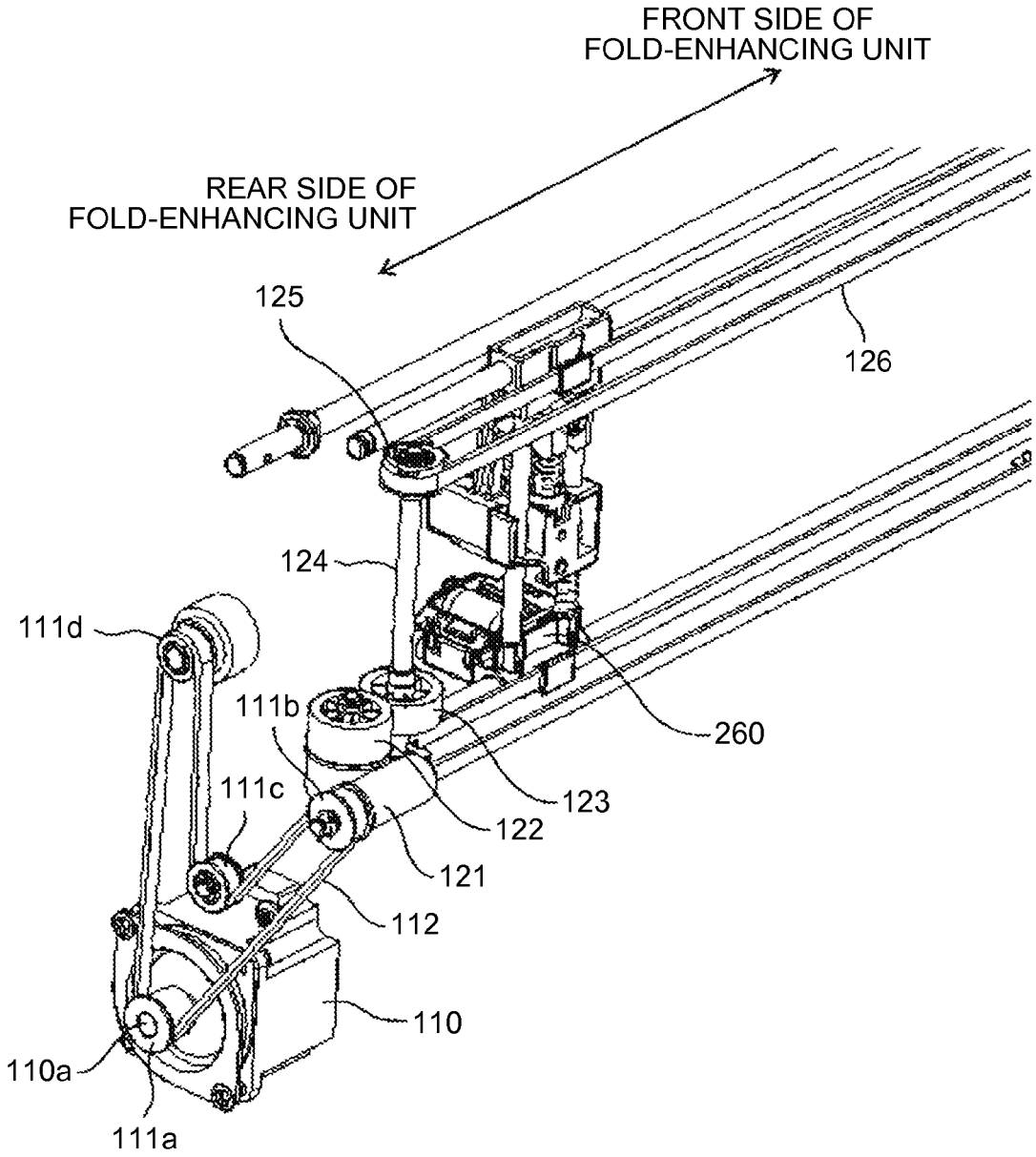
FIG. 27 is a schematic of a fold-enhancing driving system on the rear side.

FIG. 27 is a schematic illustrating a fold-enhancing roller unit driving system that is a moving unit for moving the fold-enhancing roller 260, and is assembled onto the rear side plate 102 and the rear auxiliary side plate 103.

As a driving source 110, a stepping motor or a direct current (DC) motor is generally used, and a stepping motor or a DC motor with an encoder allowing an easy positioning control is used preferably.

A timing pulley 111*a* is provided on an output shaft 110*a* of the driving source 110. A timing belt 112 is rotatably stretched around the timing pulley 111*a*, timing pulleys 111*b*, 111*c*, and 111*d*.

The driving force is transmitted from the driving source 110 to the fold-enhancing roller unit 260 while sufficient deceleration is performed by a first fold-enhancing gear 121 provided coaxially with the timing pulley 111*b*, a second fold-enhancing gear 122, and a third fold-enhancing gear 123, sequentially in this order.

In the embodiment, a worm gear is used as the first fold-enhancing gear 121, and a worm wheel is used as the second fold-enhancing gear 122 to convert the rotating direction.

On the upper end of a rotating shaft 124, lower end of which is provided with the third fold-enhancing gear 123, a fold-enhancing moving pulley 125 is provided. As the fold-enhancing moving pulley 125 is rotated, a timing belt 126 stretched around the fold-enhancing moving pulley 125 is rotated so as to cause the fold-enhancing roller unit 260 to reciprocate back and forth.

Figure 28:
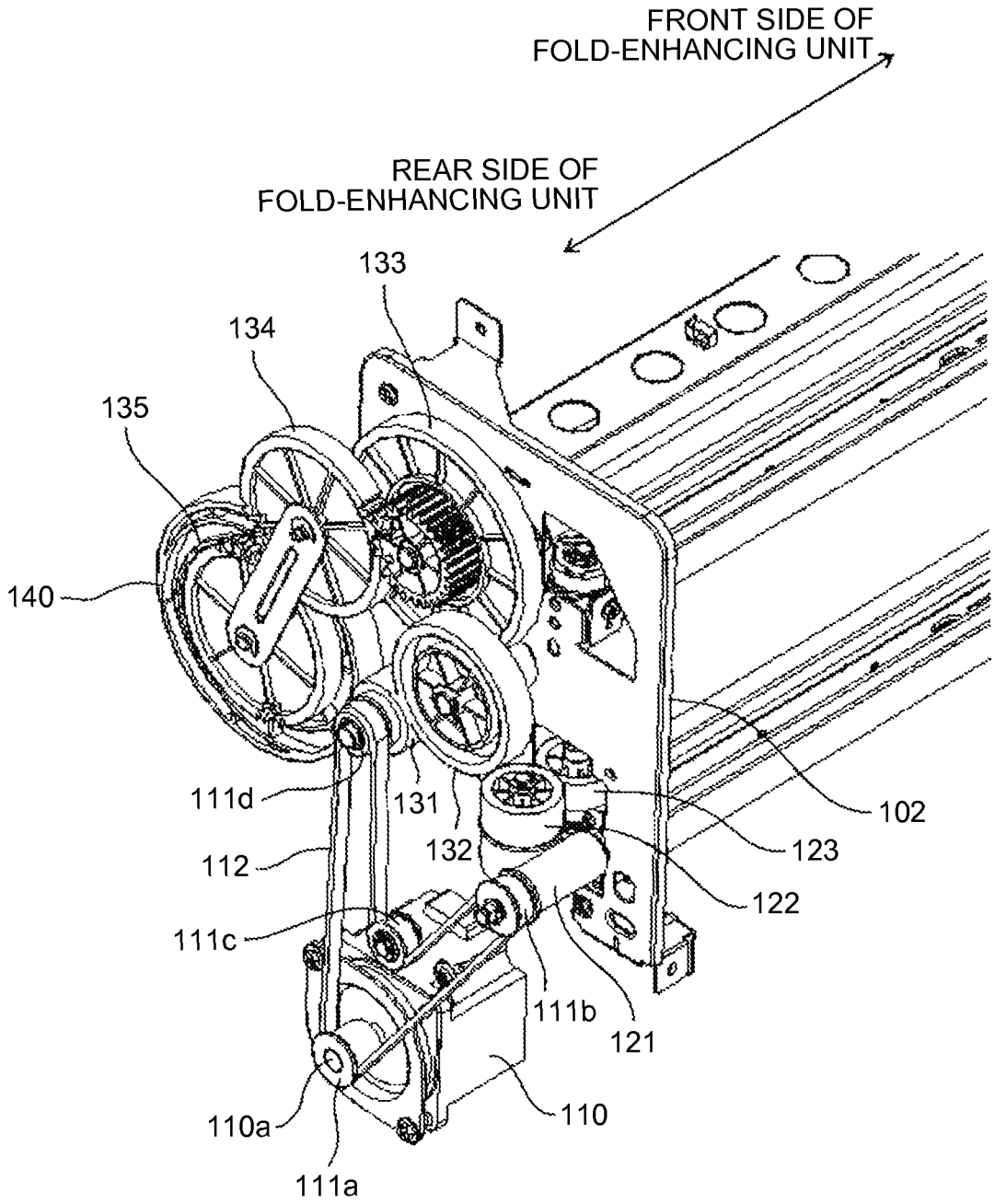
FIG. 28 is a schematic of a folding plate driving system on the rear side.

FIG. 28 is a schematic of a folding plate driving system that is a moving unit for moving the folding plate 215 assembled onto the rear side plate 102 and the rear auxiliary side plate 103, onto which the fold-enhancing roller unit driving system is also assembled.

As a driving source used in the folding plate driving system, the same driving source 110 used for the fold-enhancing roller driving system is used, so that the driving source 110 can drive both the folding plate 215 and the fold-enhancing roller unit 260. In this manner, the space and cost required can be reduced, compared with when separate driving sources are provided for the fold-enhancing roller unit driving system and the folding plate driving system.

The driving force is transmitted from the driving source 110 to the folding plate 215 while sufficient deceleration is performed by a first folding plate gear 131 on which the timing pulley 111*d* is provided, a second folding plate gear 132, a third folding plate gear 133, a fourth folding plate gear 134, and a fifth folding plate gear 135, sequentially in this order.

A folding plate driving cam 140 is connected to the fifth folding plate gear 135 so as to rotate in the same manner.

Figure 29:
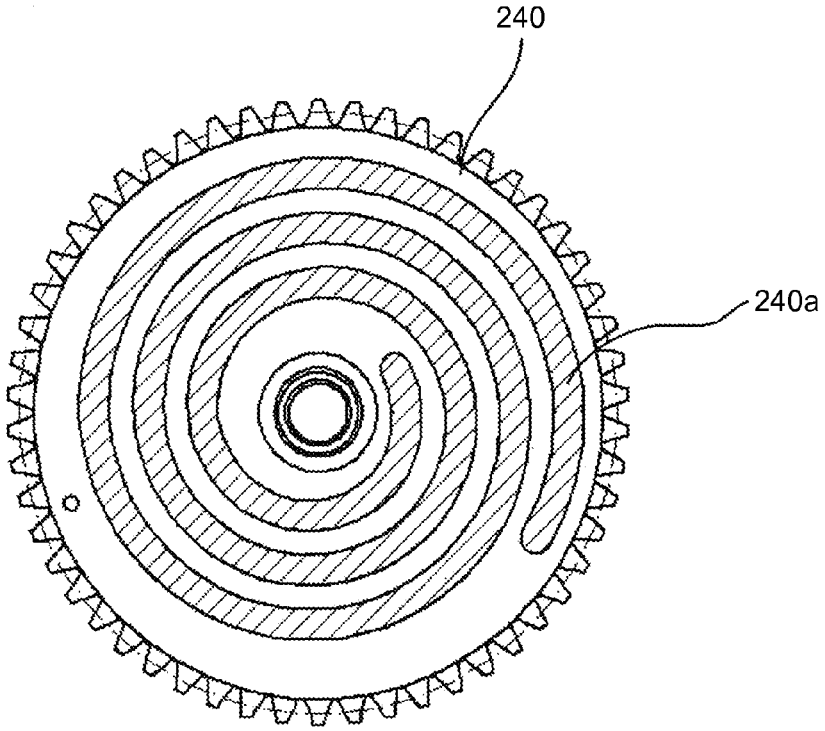
FIG. 29 is a schematic of a folding plate driving cam.
Figure 30:
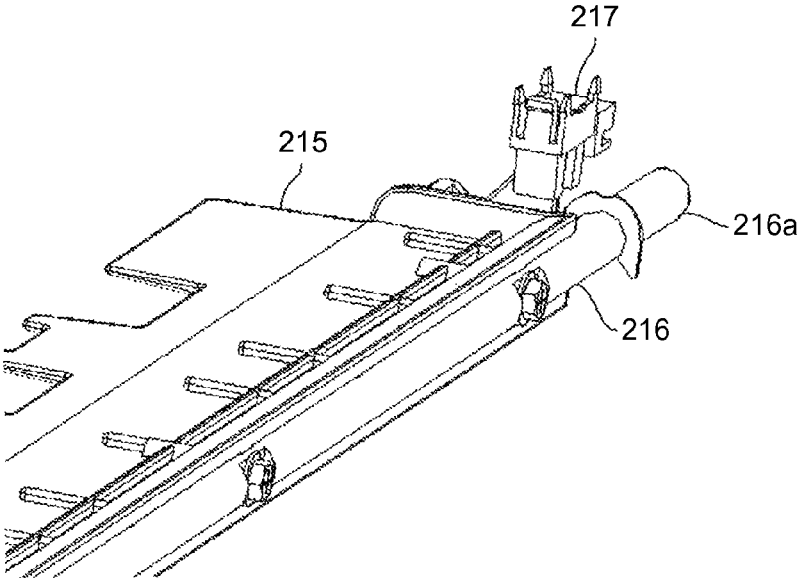
FIG. 30 is an enlarged view of one end of a folding plate.

FIG. 29 is a schematic of the folding plate driving cam 140. FIG. 30 is an enlarged view of one end of the folding plate 215.

As illustrated in FIG. 29, formed on one side surface of the folding plate driving cam 140 is a spiral-shaped groove 140*a* having a distance from the connected rotational central axis smoothly changed. As the folding plate driving cam 140 is rotated, a cam groove engaging portion 216*a* of a folding plate supporting rod 216 that is integrated with the folding plate 215 is moved along the spiral-shaped groove 140*a* on the folding plate driving cam 140, so that the folding plate 215 is moved in the horizontal direction.

In particular, each of a starting portion and an ending portion of the groove 140*a* is provided with a region where the distance from the rotational central axis remains constant, so that the folding plate 215 is not moved even when the driving source 110 rotates. With this structure, the folding plate 215 can push and guide 20 sheets at the maximum into the folding roller pair 230. The same driving mechanism is provided at the front side and the rear side so that the folding plate 215 is prevented from tilting.

Despite a cam on which the spiral-shaped groove 140*a* is formed is used as the folding plate driving cam 140, a decentered cam or a rack and pinion may also be used instead.

Figure 31:
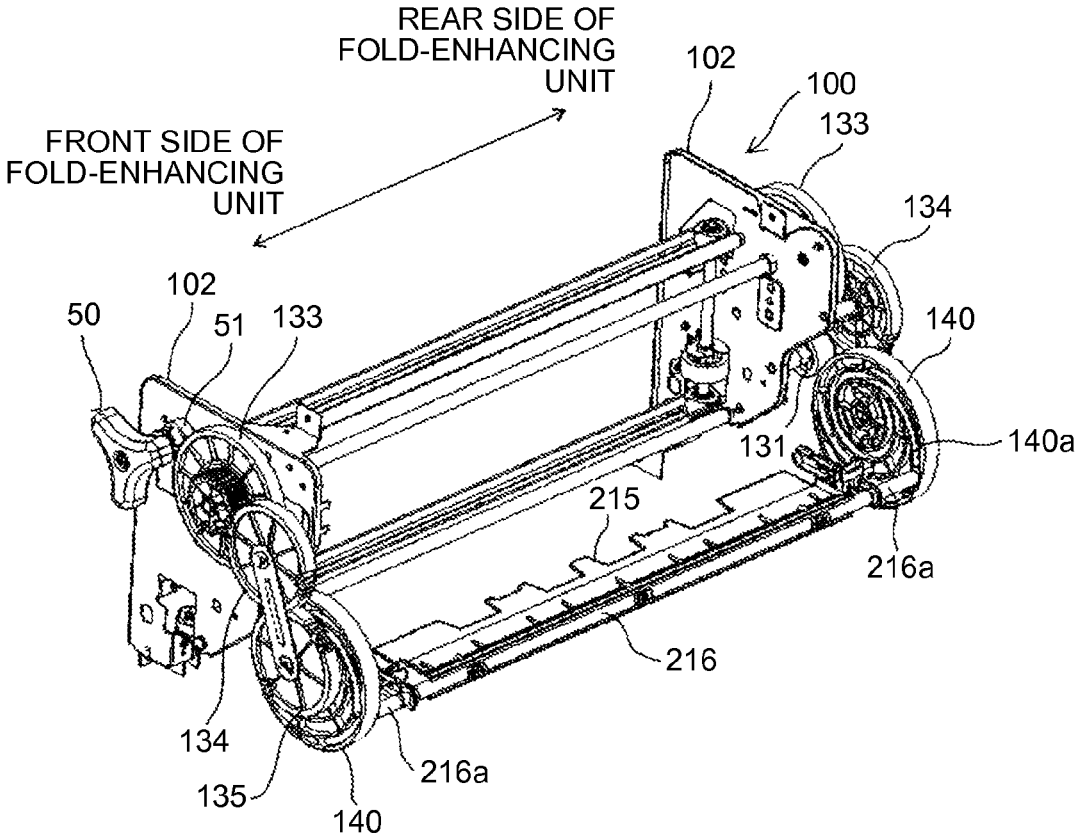
FIG. 31 is a perspective view of the fold-enhancing unit.

FIG. 31 is a perspective view of the fold-enhancing unit 100.

On the front side of the fold-enhancing unit, the operation knob 50 is provided to the drive transmission mechanism for the folding plate 215. When a user turns the operation knob 50, the operation knob gear 51 is rotated, whereby the third folding plate gear 133 engaging with the operation knob gear 51 on the front side of the fold-enhancing unit is rotated.

The third folding plate gear 133 on the front side of the fold-enhancing unit and the third folding plate gear 133 on the rear side of fold-enhancing unit are mounted on the respective ends of the same rotating shaft. When the driving force from the driving source 110 rotates the third folding plate gear 133 on the rear side of fold-enhancing unit, the third folding plate gear 133 on the front side of the fold-enhancing unit is also rotated via the rotating shaft.

When the driving force from the operation knob 50 rotates the third folding plate gear 133 on the front side of the fold-enhancing unit, the third folding plate gear 133 on the rear side of fold-enhancing unit is also rotated via the rotating shaft.

Therefore, when the user turns the operation knob 50, the folding plate driving cams 140 on the front side and on the rear side of the fold-enhancing unit are caused to rotate via the respective third folding plate gears 133, the fourth folding plate gears 134, and the fifth folding plate gears 135. In this manner, a user can perform an operation for moving the folding plate 215 manually by turning the operation knob 50 and causing the folding plate driving cams 140 to rotate.

When the user turns the operation knob 50, whereby causing the third folding plate gear 133 on the rear side of fold-enhancing unit to rotate, the timing pulley hid is rotated via the second folding plate gear 132 and the first folding plate gear 131. When the timing pulley 111*d* is rotated, the timing belt 112 is rotated. When the timing belt 112 is rotated, the timing pulley 111*b* is also rotated. In this manner, the driving force is transmitted to the fold-enhancing roller unit 260 via the first fold-enhancing gear 121 on which the timing pulley 111*b* is provided coaxially, the second fold-enhancing gear 122, and the third fold-enhancing gear 123. In other words, the user can also perform an operation of moving the fold-enhancing roller unit 260 by turning the operation knob 50.

In other words, in the saddle stitch binding apparatus 2 according to the embodiment, a single operation of a user turning the operation knob 50 can cause the folding plate 215 and the fold-enhancing roller unit 260 to be moved and to be retracted outside the conveying path area.

In this manner, the operation and the operation time required to allow a user to manually move the folding plate 215 and the fold-enhancing roller unit 260 can be simplified and reduced, compared with when separate operation knobs are provided for the folding plate 215 and the fold-enhancing roller unit 260.

In addition, the cost required can be also reduced, compared with when separate operation knobs are provided for the folding plate 215 and the fold-enhancing roller unit 260.

The folding plate 215 is also provided with a folding plate home position detecting sensor 217 for detecting the home position of the folding plate 215, as illustrated in FIG. 30.

The fold-enhancing roller unit 260 is configured to be positioned at its home position when the folding plate 215 is positioned at its home position. Therefore, when the folding plate home position detecting sensor 217 detects that the folding plate 215 is at its home position, the fold-enhancing roller unit 260 is also positioned at its home position.

Furthermore, as mentioned earlier, the folding plate 215 and the fold-enhancing roller unit 260 are configured to be driven by the same driving source 110, and the folding plate 215 and the fold-enhancing roller unit 260 are moved relatively to each other. In this manner, the same driving source 110 can move both the folding plate 215 and the fold-enhancing roller unit 260 to their respective home positions.

Therefore, when the folding plate home position detecting sensor 217 is provided, a fold-enhancing roller unit home position detecting sensor for detecting the home position of the fold-enhancing roller unit 260 is not required. Therefore, a cost can be reduced, compared with when the fold-enhancing roller unit home position detecting sensor is separately provided.

Figure 32:
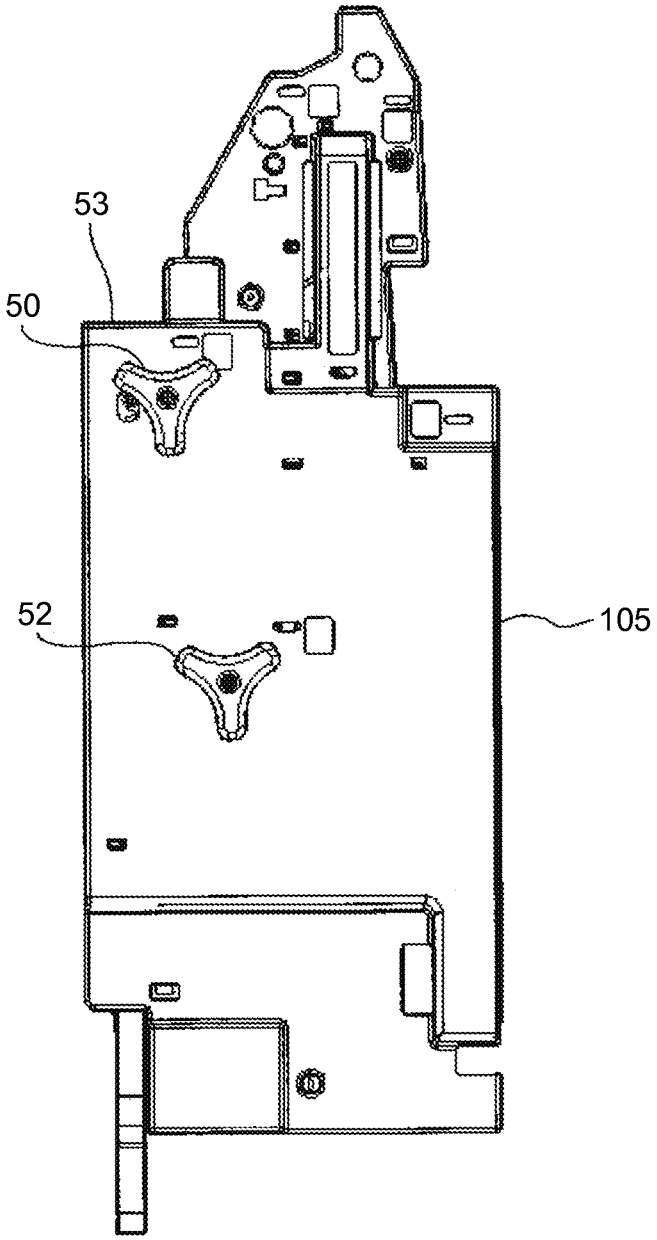
FIG. 32 is a front view of a saddle stitching unit when a front door of the saddle stitch binding apparatus is opened from the front of the saddle stitch binding apparatus.

FIG. 32 is a front view of a saddle stitching unit when a front door of the saddle stitch binding apparatus 2 is opened from the front of the saddle stitch binding apparatus.

On the front side of the saddle stitching unit in the saddle stitch binding apparatus, the operation knob 50 for allowing a user to manually operate the folding plate 215 and the fold-enhancing roller unit 260 and an operation knob 52 for allowing a user to manually operate the folding roller pair 230 are provided. A user can cause each roller in the folding roller pair 230 to rotate via a drive transmission mechanism not illustrated, by turning the operation knob 52.

Near the operation knob 50, an operation prompting light-emitting diode (LED) 53 for prompting a user to operate the operation knob 50 is provided. If the folding plate 215 is not at its home position when any abnormality such as jamming occurs, the operation prompting LED 53 is turned ON, which can prompt a user to operate the operation knob 50. When a user operates the operation knob 50 to move the folding plate 215 to its home position, the operation prompting LED 53 is turned OFF, which can notify the user that the user can finish the operation of the operation knob 50.

When any abnormality occurs, a user can retract the folding plate 215 and the fold-enhancing roller unit 260 outside the conveying path area by performing a single operation of turning the operation knob 50. The user can then operate the folding roller pair 230 by turning the operation knob 52. In this manner, a sheet stuck due to an abnormal condition such as jamming can be safely removed.

Alternatively, when any abnormality occurs, a user can perform an operation on the operation panel not illustrated to cause the driving source 110 to be driven so that the folding plate 215 and the fold-enhancing roller unit 260 are automatically returned to their respective home positions outside the conveying path area. In this manner, a user can perform a simple operation to return the folding plate 215 and the fold-enhancing roller unit 260 to their respective home positions when any abnormality occurs.

It is also possible for the driving source 110 to be exposed to an excessive load due to an operation under an abnormal condition, or for the power of the saddle stitch binding apparatus 2 to be shut down immediately after the abnormality occurs. In such cases, it becomes impossible to return the folding plate 215 and the fold-enhancing roller unit 260 to their respective home positions automatically. Therefore, problems such as that a situation where a sheet cannot be removed from the fold-enhancing unit 100 is caused occur.

In the embodiment, because a user can manually turn the operation knob 50 to return the folding plate 215 and the fold-enhancing roller unit 260 to their respective home positions, such problems can be prevented.

The structures explained above are merely examples, and there are some advantageous effects unique to the following respective aspects of the present invention.

Aspect A

A sheet processing apparatus such as the saddle stitch binding apparatus 2 includes an abutting member such as the folding plate 215 that abuts against a sheet surface to bend the sheet, a first moving unit such as the folding plate driving system that moves the abutting member, a folding unit such as the folding roller pair 230 that performs a folding process on the sheet bent by the abutting member, a pressing unit such as the fold-enhancing roller unit 260 that presses a folded portion of the sheet subjected to the folding process, a second moving unit such as the fold-enhancing roller unit driving system that moves the pressing unit in a direction along a fold of the sheet, and a single operation unit such as the operation knob 50 that allows the first moving unit and the second moving unit to be operated. This configuration can reduce the cumbersomeness and the operation time required for an operator to manually make an operation for moving the abutting member and the pressing unit, as explained earlier with the preferred embodiment.

Aspect B

In Aspect A, the first moving unit and the second moving unit are driven by a single driving source such as the driving source 110. This configuration can reduce the space and cost required compared with when separate driving sources are provided for the first moving unit and the second moving unit.

Aspect C

In Aspect B, when one of the abutting member and the pressing unit is positioned at a corresponding home position, the other is also at a corresponding home position. The abutting member and the pressing unit can be thus brought to their respective home positions by the single driving source, as explained earlier with the preferred embodiment.

Aspect D

In Aspect B or Aspect C, the first moving unit includes a drive transmission unit such as the folding plate driving cam 140 that transmits a driving force from the single driving source to the abutting member and that is configured not to move the abutting member upon receiving the driving force from the single driving source, for a given extent, when the abutting member is positioned at a predetermined position. The positions of the abutting member and the pressing member can be thus controlled as appropriate using the single driving source, as explained earlier with the preferred embodiment.

Aspect E

In any one of Aspect A, Aspect B, Aspect C, and Aspect D, the sheet processing apparatus further includes an instructing unit such as the operation panel that allows an operator to give an instruction to move the abutting member and the pressing unit, and the first moving unit and the second moving unit are caused to move the abutting member and the pressing unit, respectively, based on the instruction from the instructing unit. The abutting member and the pressing unit can be thus automatically moved to their respective home positions when any abnormality occurs, by allowing an operator to give an instruction to move the abutting member and the pressing unit, as explained earlier with the preferred embodiment.

Aspect F

In any one of Aspect A, Aspect B, Aspect C, Aspect D, and Aspect E, only one of the abutting member and the pressing unit is provided with a position detecting unit such as the folding plate home position detecting sensor 217 configured to detect the position of the abutting member or the position of the pressing unit. This configuration can reduce the cost required compared with when separate position detection units are provided for the abutting member and the pressing unit, as explained earlier with the preferred embodiment.

Aspect G

In Aspect F, the position detecting unit is configured to detect the home position of the abutting member or the home position of the pressing unit, and the home position is provided outside a sheet conveying path. This configuration can detect whether the abutting member and the pressing member are positioned at their respective home positions outside the sheet conveying path, as explained earlier with the preferred embodiment.

Aspect H

In Aspect G, the sheet processing apparatus includes an informing unit such as the operation prompting LED 53 that is configured to inform an operator that the abutting member or the pressing unit is not at the home position, based on a detection result of the position detecting unit. When the abutting member and the pressing member are not at their respective home positions when an abnormality occurs, for example, the informing unit can prompt an operator to operate the operating unit, as explained earlier with the preferred embodiment.

Aspect I

In an image forming system such as the image forming system 4 including an image forming apparatus such as the image forming apparatus 1 that forms an image on a sheet, and a sheet processing apparatus such as the saddle stitch binding apparatus 2 that performs a folding process on the sheet on which an image is formed by the image forming apparatus, the sheet processing apparatus is the sheet processing apparatus according to any one of Aspect A, Aspect B, Aspect C, Aspect D, Aspect E, Aspect F, Aspect G, and Aspect H. This configuration can reduce the cumbersomeness and the operation time required for an operator to manually make an operation for moving the abutting member and the pressing unit, as explained earlier with the preferred embodiment.

According to an aspect, the abutting member and the pressing unit can be moved with a single operation of an operator manually operating a single operation unit. Thereby, the operation can be simplified and the operation time can be reduced, compared with when separate operation units are provided to the abutting member and the pressing unit to allow the abutting member and the pressing unit to be manually moved by an operator.

According to an aspect, the cumbersomeness and the operation time required for an operator to manually make an operation for moving the abutting member and the pressing unit can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

an abutting member that abuts against a sheet surface to bend a sheet;

a first moving unit that moves the abutting member;

a folding unit that performs a folding process on the sheet bent by the abutting member;

a pressing unit that presses a folded portion of the sheet subjected to the folding process;

a second moving unit that moves the pressing unit in a direction along a fold of the sheet; and a single operation unit that allows the first moving unit and the second moving unit to be operated.

2. The sheet processing apparatus according to claim 1, wherein the first moving unit and the second moving unit are driven by a single driving source.

3. The sheet processing apparatus according to claim 2, wherein, when one of the abutting member and the pressing unit is positioned at a corresponding home position, the other is also at a corresponding home position.

4. The sheet processing apparatus according to claim 2, wherein the first moving unit comprises a drive transmission unit that transmits a driving force from the single driving source to the abutting member and is configured not to move the abutting member upon receiving the driving force from the single driving source, for a given extent, when the abutting member is positioned at a predetermined position.

5. The sheet processing apparatus according to claim further comprising:

an instructing unit that allows an operator to give an instruction to move the abutting member and the pressing unit, wherein the first moving unit and the second moving unit are caused to move the abutting member and the pressing unit, respectively, based on the instruction from the instructing unit.

6. The sheet processing apparatus according to claim 1, wherein only one of the abutting member and the pressing unit is provided with a position detecting unit configured to detect a position of the one of the abutting member and of the pressing unit.

7. The sheet processing apparatus according to claim 6, wherein the position detecting unit is configured to detect a home position of the abutting member or a home position of the pressing unit, and the home position is provided outside a sheet conveying path.

8. The sheet processing apparatus according to claim 6, further comprising an informing unit that is configured to inform an operator that the abutting member or the pressing unit is not at the home position, based on a detection result of the position detecting unit.

9. An image forming system comprising:

an image forming apparatus that forms an image on a sheet; and a sheet processing apparatus that performs a folding process on the sheet on which an image is formed by the image forming apparatus, wherein the sheet processing apparatus comprising:

an abutting member that abuts against a sheet surface to bend a sheet;

a first moving unit that moves the abutting member;

a folding unit that performs a folding process on the sheet bent by the abutting member;

a pressing unit that presses a folded portion of the sheet subjected to the folding process;

a second moving unit that moves the pressing unit in a direction along a fold of the sheet; and a single operation unit that allows the first moving unit and the second moving unit to be operated.

* * * * *